US008523290B2

(12) United States Patent
Helsel et al.

(10) Patent No.: US 8,523,290 B2
(45) Date of Patent: Sep. 3, 2013

(54) ROTATABLE CUTTING TOOL-TOOL HOLDER-BASE ASSEMBLY

(75) Inventors: Eric P. Helsel, New Enterprise, PA (US); Donald Keller, Bedford, PA (US); Don Rowlett, Bedford, PA (US); Stephen Stiffler, New Enterprise, PA (US); Wayne Beach, Roaring Spring, PA (US)

(73) Assignee: Kennametal Inc., Latrobe, PA (US)

( * ) Notice: Subject to any disclaimer, the term of this patent is extended or adjusted under 35 U.S.C. 154(b) by 504 days.

(21) Appl. No.: 12/755,745

(22) Filed: Apr. 7, 2010

(65) Prior Publication Data

US 2011/0089746 A1 Apr. 21, 2011

Related U.S. Application Data

(60) Provisional application No. 61/168,272, filed on Apr. 10, 2009.

(51) Int. Cl.
*E21C 35/19* (2006.01)

(52) U.S. Cl.
USPC ..... 299/105; 299/106

(58) Field of Classification Search
USPC ..... 299/104, 105, 106, 102
See application file for complete search history.

(56) References Cited

U.S. PATENT DOCUMENTS

| | | | | |
|---|---|---|---|---|
| 3,622,206 | A | 11/1971 | Krekeler | |
| 3,749,449 | A | 7/1973 | Krekeler | |
| 4,163,581 | A * | 8/1979 | Krekeler | 299/102 |
| 4,497,520 | A | 2/1985 | Ojanen | |
| 4,650,254 | A | 3/1987 | Wechner | |
| 4,955,264 | A | 9/1990 | Armbrust | |
| 5,067,775 | A | 11/1991 | D'Angelo | |
| 5,605,382 | A | 2/1997 | Massa | |
| 5,607,206 | A | 3/1997 | Siddle et al. | |
| 5,769,505 | A | 6/1998 | Siddle et al. | |
| 5,833,323 | A | 11/1998 | Massa et al. | |
| 6,129,422 | A | 10/2000 | Siddle et al. | |
| 6,220,671 | B1 | 4/2001 | Montgomery, Jr. | |
| 6,234,579 | B1 | 5/2001 | Montgomery, Jr. | |
| 6,331,035 | B1 * | 12/2001 | Montgomery, Jr. | 299/106 |

(Continued)

OTHER PUBLICATIONS

PCT US 10/30416 Notofication of Transmittal of the International Search Report and the Written Opinion Jun. 28, 2010 (2 pages).

(Continued)

*Primary Examiner* — John Kreck
(74) *Attorney, Agent, or Firm* — Matthew W. Smith, Esq.

(57) ABSTRACT

A cutting tool holder-base assembly (399) has a base (400). The base (400) is adapted to attach to a surface (40) of a rotatable driving member (38). The tool holder-base assembly (399) includes a cutting tool holder (500) with head region (502) containing a cutting tool bore (506), and a shank region (504) with a distal end (524). The shank region (504) has an alignment notch (528) presenting an alignment surface (530) at the distal end (524). The assembly (399) further has a base (400), which contains a tool holder bore (418) and a transverse passage (430) intersecting the tool holder bore (418). There is an elongate pin (436) in the transverse passage (430). The elongate pin (436) has an exposed portion (440) thereof passing through the tool holder bore (418) wherein the cutting tool holder (500) is able to enter completely the tool holder bore (418) of the base (400) when the alignment surface (530) is in alignment with the exposed portion (440) of the elongate pin (436).

5 Claims, 24 Drawing Sheets

(56) References Cited

U.S. PATENT DOCUMENTS

| | | | | |
|---|---|---|---|---|
| 7,070,244 | B2 | 7/2006 | Fischer et al. | |
| 7,144,192 | B2 | 12/2006 | Holl et al. | |
| 7,300,115 | B2 * | 11/2007 | Holl et al. | 299/106 |
| 7,370,916 | B2 | 5/2008 | Ley et al. | |
| 7,380,887 | B2 * | 6/2008 | Latham | 299/87.1 |
| 2006/0243840 | A1 | 11/2006 | Latham | |
| 2007/0052279 | A1 * | 3/2007 | Sollami | 299/106 |
| 2009/0085396 | A1 * | 4/2009 | Chiang | 299/102 |
| 2009/0091177 | A1 * | 4/2009 | Moore | 299/102 |
| 2011/0089747 | A1 * | 4/2011 | Helsel et al. | 299/104 |

OTHER PUBLICATIONS

PCT US 10/30416 International Search Report Jun. 28, 2010 (2 pages).

PCT US 10/30416 Written Opinion of the International Searching Authority Jun. 28, 2010 (5 pages).

* cited by examiner

ROTATABLE CUTTING TOOL-TOOL HOLDER-BASE ASSEMBLY

CROSS-REFERENCE TO EARLIER PATENT APPLICATION

This patent application is a non-provisional patent application is based in part upon U.S. Provisional Patent Application Ser. No. 61/168,272 filed on Apr. 10, 2009 by Eric P. Helsel, Donald E. Keller, Don Rowlett, Stephen P. Stiffler and Wayne Beach for a ROTATABLE CUTTING TOOL-TOOL HOLDER-BASE ASSEMBLY. Under the United States Patent Statute, applicants hereby claim the priority of said provisional patent application (U.S. Provisional Patent Application Ser. No. 61/168,272 filed on Apr. 10, 2009 by Helsel et al. for a ROTATABLE CUTTING TOOL-TOOL HOLDER-BASE ASSEMBLY). Further, applicants hereby incorporate by reference herein the entirety of the U.S. Provisional Patent Application Ser. No. 61/168,272 filed on Apr. 10, 2009 to Helsel et al.

BACKGROUND OF THE INVENTION

The invention pertains to a rotatable cutting tool-tool holder-base assembly, as well as the individual components of the assembly. One typically uses such an assembly in conjunction with the rotatable drum or driven member. The driven member rotates in such a fashion to drive the rotatable cutting tool into earth strata to disintegrate the same into smaller pieces including fine particulates, i.e., cutting debris. Such a rotatable cutting tool-tool holder-base assembly has application in a number of specific environments. One specific environment is mining as a component of a mining machine. Another specific environment is road construction as a component of a road planing machine or a road milling machine.

Mining machines and construction machines (e.g., a road planing machine or road milling machine) are useful in continuous mining or road milling applications to mine or mill earth strata such as, for example, coal, asphalt, concrete and the like. These mining machines and construction machines utilize cutting bit assemblies. Each cutting bit assemblies for continuous mining or road milling applications typically comprises a cutting bit rotatably mounted within a support block. In turn, the support block mounts, typically by welding, on a drum or other body, wherein a suitable power source (or means) drives the drum.

When a number of such support blocks carrying cutting bits are mounted onto a drum, and the drum is driven, the cutting bits will impinge and break up the earth strata into many pieces (i.e., cutting debris). Skilled artisans know the general operation of such a mining machine or construction machine. U.S. Pat. No. 7,144,192 to Holl et al. for a SELF-PROPELLED ROAD MILLING MACHINE, U.S. Pat. No. 7,370,916 to Ley et al. for a REAR LOADER ROAD MILLING MACHINE WITH HEIGHT-ADJUSTABLE SEALING DEVICE, and U.S. Pat. No. 7,070,244 to Fischer et al. for a ROAD MILLING MACHINE are exemplary patent documents that disclose such mining machines and/or construction machines.

During operation of the mining or construction machine, the support block experiences wear due to exposure thereof to the cutting debris. Over time, wear and other kinds of abuse causes the support block to become ineffective which signals an end to its useful life. Once this occurs, the operator must cut or torch the support block off the drum to allow for replacement of the support block. Typically, the operator welds the replacement support block on the drum. As the skilled artisan appreciates, it is time-consuming, and hence costly, to remove and replace a support block. Thus, there is an advantage to be able to prolong the useful life of the support block.

To prolong the life of the support block, one may use a cutting bit holder, sometimes referred to as a cutting bit sleeve, wherein the cutting bit rotatably or otherwise releasably mounts within the cutting bit holder. The cutting bit holder mounts within the support block via a mechanical connection. The presence of the cutting bit holder helps protect the support block from abuse and wear, thus minimizing or eliminating the periods of down time otherwise required for drum repair. The skilled artisan is aware of the use of cutting bit holders.

The skilled artisan is aware that cutting bits and cutting bit holders are subjected to considerable stresses during mining operations, road milling operations or other like operations. Accordingly, there is a desire to mount the cutting bit holder in the support block to minimize movement of the cutting bit holder in order to maximize the useful life of the cutting bit.

It is also important that the mounting between the cutting bit holder and the support block be resistant to vibratory loosening which could likewise lead to premature cutting bit wear and failure. Heretofore, various structures exist to mount a cutting bit sleeve within a support block in an attempt to minimize cutting bit holder movement or loosening, while maximizing cutting bit life.

A mining machine or a road milling machine operates typically in severe operating conditions. During operation, the cutting bit holder (or tool holder) and/or the support block (or base) can experience damage such that it is difficult to disassemble these components. It is an advantage to be able to disassemble the cutting bit holder from the support block. Thus, it would be highly desirable to provide a cutting bit holder-support block assembly that facilitates a relatively easy disassembly of the cutting bit holder from the support block. Further, during operation, the severe operating conditions can also cause the rotatable cutting bit to lodge in the bore of the cutting bit holder. It would be advantageous to disassemble the cutting bit from the cutting bit holder. Thus, it is highly desirable to provide a cutting bit-cutting bit holder assembly that facilitates the relatively easy disassembly of the cutting bit from the cutting bit holder.

The following patent documents are exemplary of these various structures: U.S. Pat. No. 5,067,775 to D'Angelo for RETAINER FOR ROTATABLE BITS; U.S. Pat. No. 6,129,422 to Siddle et al. for a CUTTING TOOL HOLDER RETENTION SYSTEM; U.S. Pat. No. 5,769,505 to Siddle et al. for a CUTTING TOOL HOLDER RETENTION SYSTEM; U.S. Pat. No. 6,220,671 to Montgomery, Jr. for a CUTTING TOOL HOLDER RETENTION SYSTEM; U.S. Pat. No. 6,234,579 to Montgomery, Jr. for a CUTTING TOOL HOLDER RETENTION SYSTEM; U.S. Pat. No. 6,331,035 to Montgomery, Jr. for a CUTTING TOOL HOLDER ASSEMBLY WITH PRESS FIT; U.S. Pat. No. 3,749,449 to Krekeler for a MEANS FOR REMOVABLY AFFIXING CUTTER BIT AND LUG ASSEMBLIES TO DRIVER ELEMENT OF A MINING MACHINE OR THE LIKE; U.S. Pat. No. 4,650,254 to Wechner for a BIT HOLDER; and U.S. Pat. No. 5,607,206 to Siddle et al. for a CUTTING TOOL HOLDER RETENTION SYSTEM.

SUMMARY OF THE INVENTION

In one form thereof, the invention is a tool holder-base assembly wherein the base is adapted to attach to a surface of a rotatable driving member. The tool holder-base assembly comprises a base wherein the base contains a tool holder bore, which has a tool holder bore central longitudinal axis. The base further contains an orientation bore, which has an orientation bore central longitudinal axis. The orientation bore opens into the tool holder bore. The orientation bore central longitudinal axis is disposed generally perpendicular to the tool holder bore central longitudinal axis. The assembly further has a tool holder that has a leading head region and a trailing shank region, and a mediate region intermediate of and contiguous with the leading head region and the trailing shank region. The leading head region of the tool holder contains a rotatably cutting tool bore. The trailing shank region contains an orientation slot. The mediate region presents a forward protective surface defining debris diversion surfaces. An orientation pin is received within the orientation bore so as to project into the orientation slot. The orientation pin cooperates with the orientation slot in the holder so the tool holder presents a correct orientation relative to the base.

In another form thereof, the invention is a tool holder-base assembly wherein the base is adapted to attach to a surface of a rotatable driving member. The tool holder-base assembly comprises a base wherein the base has a proximate region and a distal region. The proximate region has a surface that is attachable to the surface of the rotatable driving member. The base contains a tool holder bore that has a tool holder bore central longitudinal axis. The base further contains an orientation bore that has an orientation bore central longitudinal axis. The orientation bore opens into the tool holder bore. The orientation bore central longitudinal axis is disposed generally perpendicular to the tool holder bore central longitudinal axis. The assembly has a tool holder that has a leading head region, a trailing shank region, and a mediate region intermediate of and contiguous with the leading head region and the trailing shank region. The leading head region of the tool holder contains a rotatably cutting tool bore. The trailing shank region contains an orientation slot. The mediate region presents a forward protective surface defining debris diversion surfaces. An orientation pin is received within the orientation bore so as to project into the orientation slot. The orientation pin cooperates with the orientation slot in the holder so the tool holder presents a correct orientation relative to the base. There is a coolant passage extending from the proximate region of the base through the tool holder exiting at the forward protective surface. The assembly also has a nozzle in the coolant passage adjacent the forward protective surface to spray coolant in the vicinity of the forward protective surface.

In still another form thereof, the invention is a cutting tool holder-base assembly wherein the base is adapted to attach to a surface of a rotatable driving member. The tool holder-base assembly comprises a cutting tool holder that has a head region, which contains a cutting tool bore. The cutting tool holder further has a shank region with a distal end wherein the shank region has an alignment notch presenting an alignment surface at the distal end. The assembly has a base that contains a tool holder bore. The base further contains a transverse passage intersecting the tool holder bore. The assembly also has an elongate pin in the transverse passage. The elongate pin has an exposed portion thereof passing through the tool holder bore wherein the cutting tool holder is able to enter completely the tool holder bore of the base when the alignment surface is in alignment with the exposed portion of the elongate pin.

BRIEF DESCRIPTION OF THE DRAWINGS

The following is a brief description of the drawings that form a part of this patent application.

DETAILED DESCRIPTION OF SPECIFIC EMBODIMENTS

Figure 14:
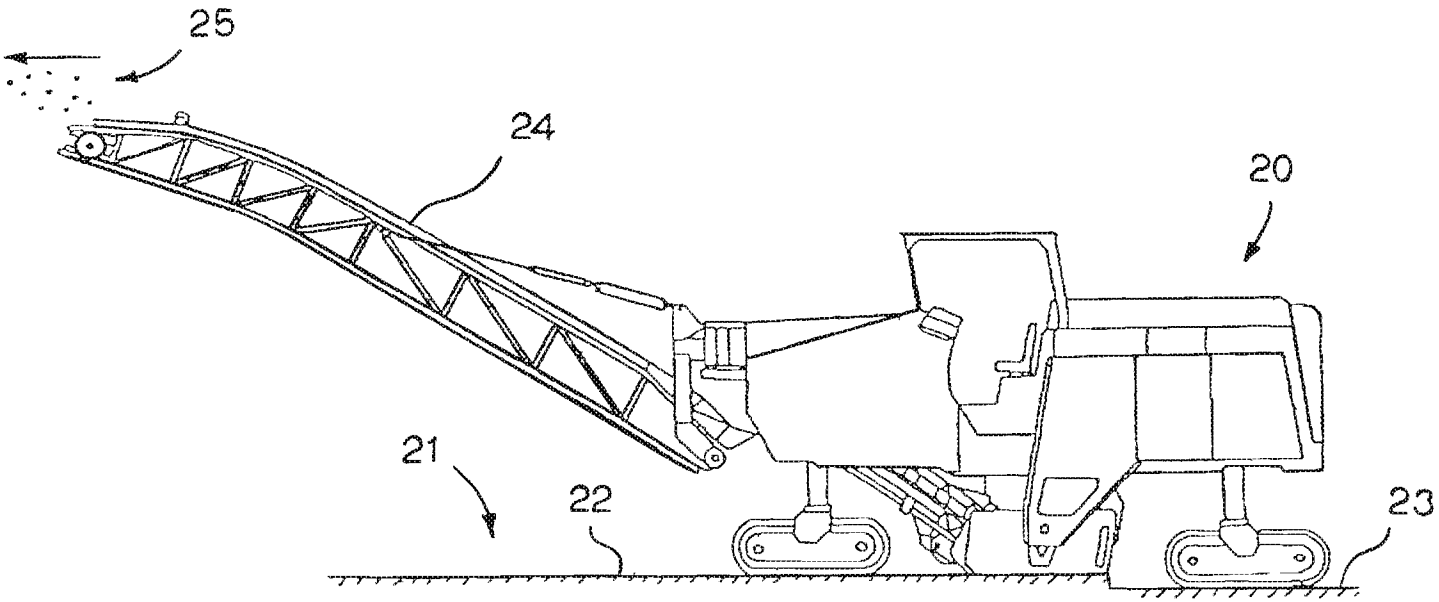
FIG. 14 is a side view of a road milling machine in operation showing a milled surface of the roadway and an unmilled surface of the roadway along with debris exiting the conveyor of the road milling machine.
Figure 15:
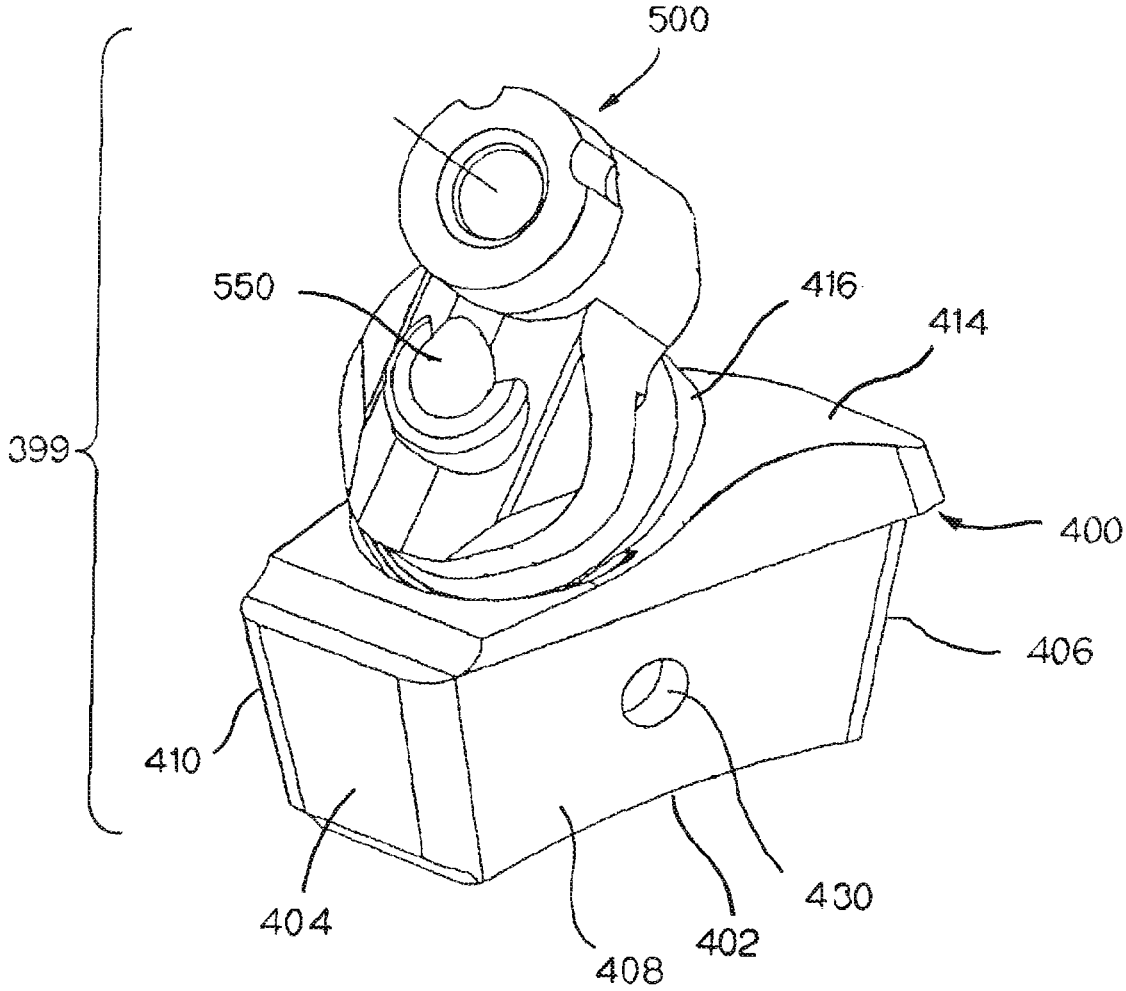
FIG. 15 is an isometric view of another specific embodiment of a tool holder-base assembly wherein the tool holder is connected to the base.

Referring to the drawings, FIG. 14 shows a road milling machine generally designated as 20. Road milling machine 20 travels over a roadway generally designated as 21 wherein the roadway 21 exhibits an unmilled roadway 22 and a milling roadway 23. FIG. 14 illustrates the milled roadway 23 as having a top layer removed to be lower than the unmilled roadway 22.

As the skilled artisan appreciates, the road milling machine contains a rotatable road milling drum. Road milling drum presents a cylindrical surface. A plurality of bases (or support blocks), which are described hereinafter, mount such as, for example, by welding of the cylindrical surface. As will be described hereinafter for a specific embodiment, each base or support block retains a tool holder or cutting bit holder, and the tool holder retains a cutting bit (e.g., a rotatable cutting bit). The assembly comprises the base and the tool holder. When a number of such assemblies carrying cutting bits (i.e., cutting bit assemblies) mount to a drum, and the drum is driven, the cutting bits impinge and break up the earth strata (e.g., asphaltic roadway material, concrete, coal, and the like) into many pieces (i.e., cutting debris). The road milling machine includes a conveyor 24 from which asphaltic debris (or milling debris) exits (see 25) during operation. U.S. Pat. No. 7,144,192 to Holl et al. for a SELF-PROPELLED ROAD MILLING MACHINE, U.S. Pat. No. 7,370,916 to Ley et al. for a REAR LOADER ROAD MILLING MACHINE WITH HEIGHT-ADJUSTABLE SEALING DEVICE, and U.S. Pat. No. 7,070,244 to Fischer et al. for a ROAD MILLING MACHINE disclose exemplary road milling machines.

During operation of the road milling machine, the support block experiences wear due to exposure thereof to the cutting debris. Over time, wear and other kinds of abuse causes the support block to be ineffective which signals an end to its useful life. Once this occurs, the operator must cut or torch the support block off the drum to allow for replacement of the support block. Typically, the operator welds the replacement support block to the drum. As the skilled artisan appreciates, it is time-consuming and hence costly, to remove and replace a support block. Thus, there is an advantage to be able to prolong the useful life of the support block. The present invention provides for that advantage.

The cutting bits and cutting bit holders are subjected to considerable stresses during road milling operations. Accordingly, there is a desire to mount the cutting bit holder in the support block to minimize movement of the cutting bit holder in order to maximize the useful life of the cutting bit. It is also important that the mounting between the cutting bit holder and the support block be resistant to vibratory loosening which could likewise lead to premature cutting bit wear and failure. The present invention provides a secure mounting of the cutting bit to the tool holder and of the tool holder to the base.

A mining machine or a road milling machine operates typically in severe operating conditions. During operation, the cutting bit holder (or tool holder) and/or the support block (or base) can experience damage such that it is difficult to disassemble these components. It is an advantage to be able to disassemble the cutting bit holder from the support block. The present invention provides the feature of a cutting bit holder-support block assembly that facilitates a relatively easy disassembly of the cutting bit holder from the support block. Further, during operation, the severe operating conditions can also cause the rotatable cutting bit to lodge in the bore of the cutting bit holder. It would be advantageous to disassemble the cutting bit from the cutting bit holder. Thus, it is highly desirable to provide a cutting bit-cutting bit holder assembly that facilitates the relatively easy disassembly of the cutting bit from the cutting bit holder.

Figure 1:
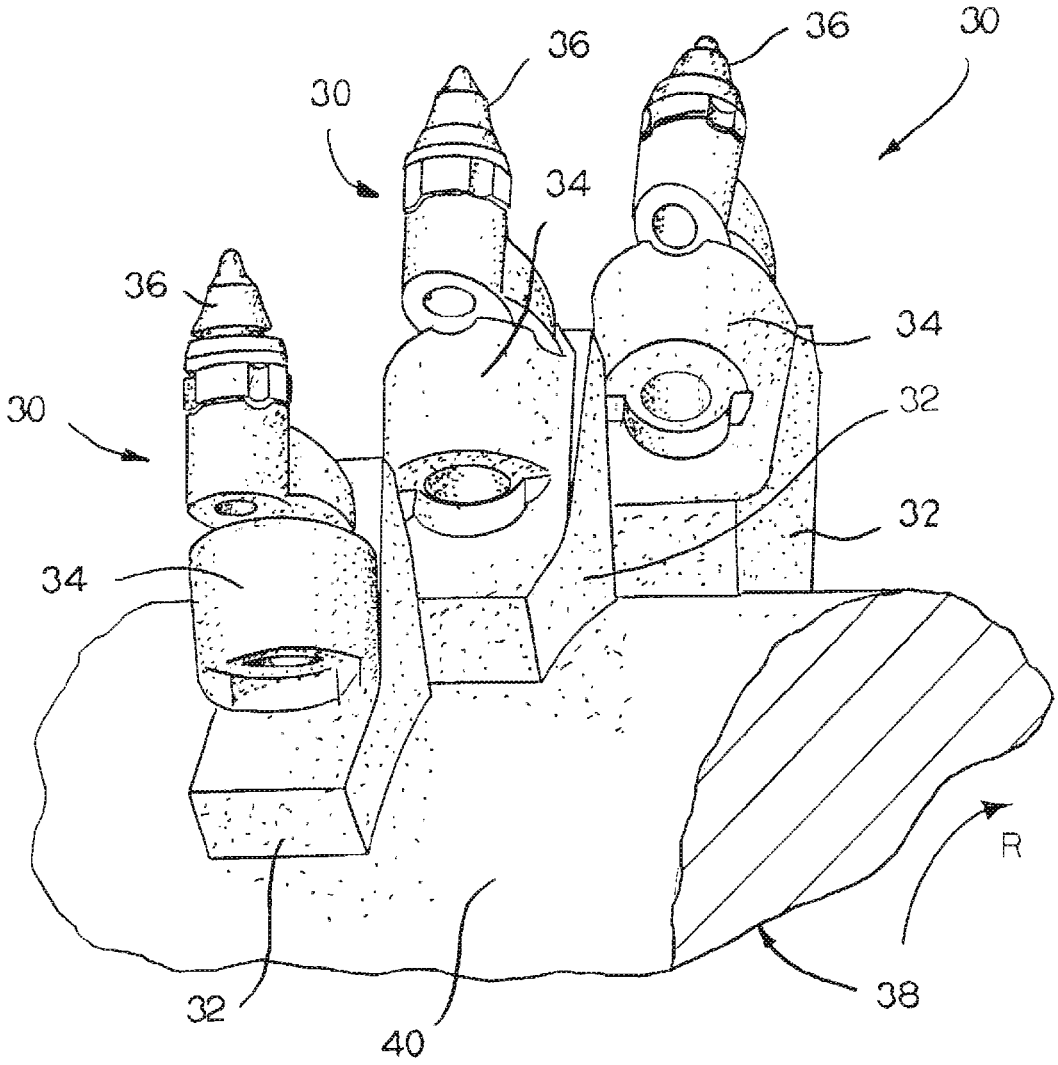
FIG. 1 is an isometric view of a portion of a rotatable drum (i.e., a rotatable driving member) showing three rotatable cutting tool-tool holder-base assemblies attached to the surface of the rotatable drum and wherein the rotatable cutting tool-tool holder-base assembles have a generally forward orientation.
Figure 1A:
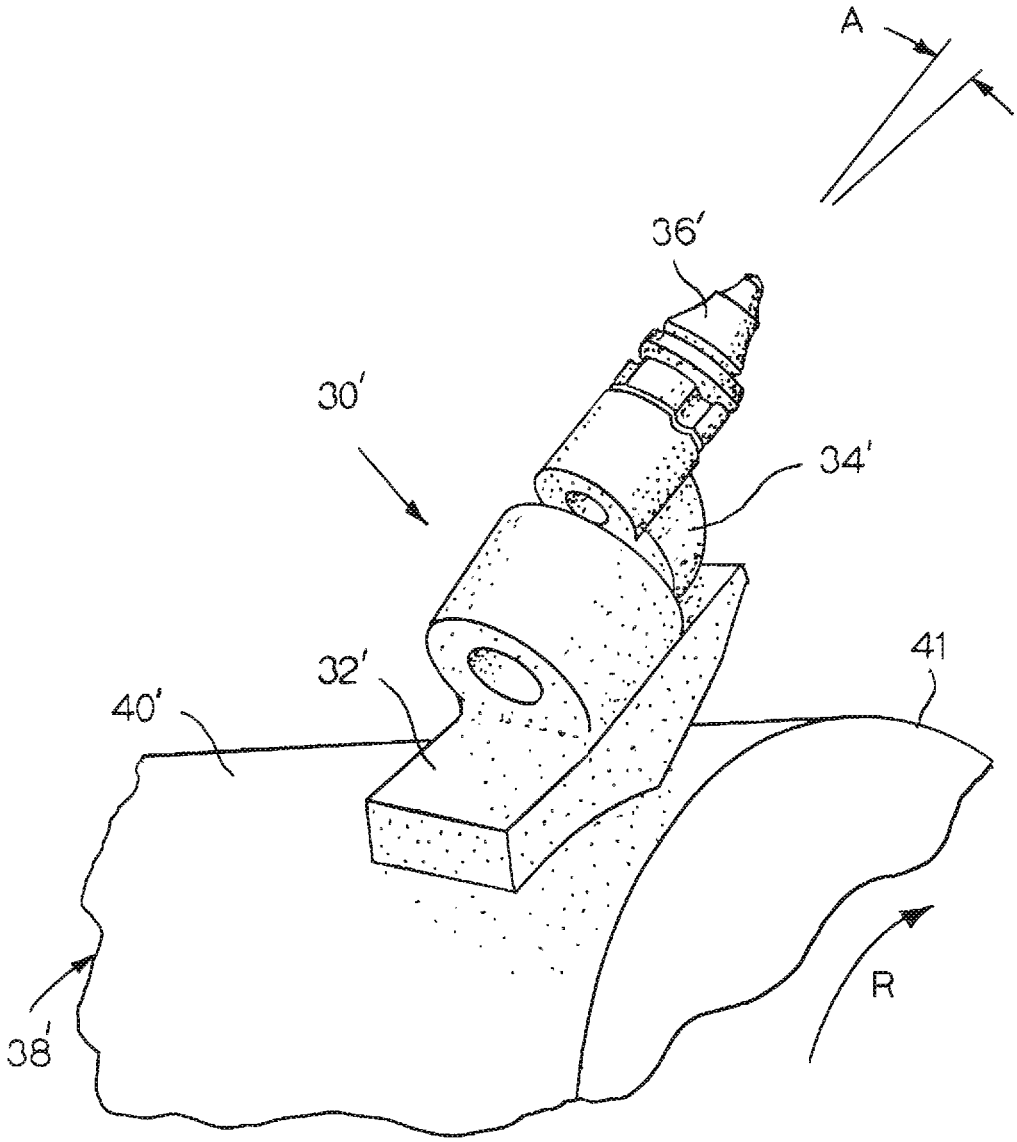
FIG. 1A is an isometric view of a portion of a rotatable drum (i.e., a rotatable driving member) showing one rotatable cutting tool-tool holder-base assembly attached to the surface of the rotatable drum and wherein the rotatable cutting tool-tool holder-base assembly has an orientation toward the edge of the rotatable drum.

Referring to the drawings, the embodiments of FIGS. 1 and 1A show the rotatable cutting tool-tool holder-base assembly generally designated as 30 in different orientations. FIG. 1 is an isometric view of a portion of a rotatable drum (i.e., a rotatable driving member) 38, which could be the road milling machine 20. FIG. 1 shows three rotatable cutting tool-tool holder-base assemblies 30 attached to the surface 40 of the rotatable drum 38. In this embodiment, the rotatable cutting tool-tool holder-base assembles 30 each have a generally forward orientation. The arrow "R" shows the direction of rotation of the rotatable drum 38. FIG. 1 also shows the base 32 attached to the surface 40 of the driven member 38. A tool holder 34 is connected or attached to the base 32. The cutting tool holder 34 rotatably receives the rotatable cutting tool 36.

FIG. 1A is an isometric view of a portion of a rotatable drum (i.e., a rotatable driving member) 38' showing one rotatable cutting tool-tool holder-base assembly 30' attached to the surface 40' of the rotatable drum 38'. The rotatable cutting tool-tool holder-base assembly 30' has an orientation at an angle A toward the edge 41 of the rotatable drum 38'. The arrow "R'" shows the direction of rotation of the rotatable drum 38'. FIG. 1A also shows the base 32' attached to the surface 40' of the driven member 38'. A tool holder 34' is connected or attached to the base 32'. The cutting tool holder 34' rotatably receives the rotatable cutting tool 36'.

Figure 2:
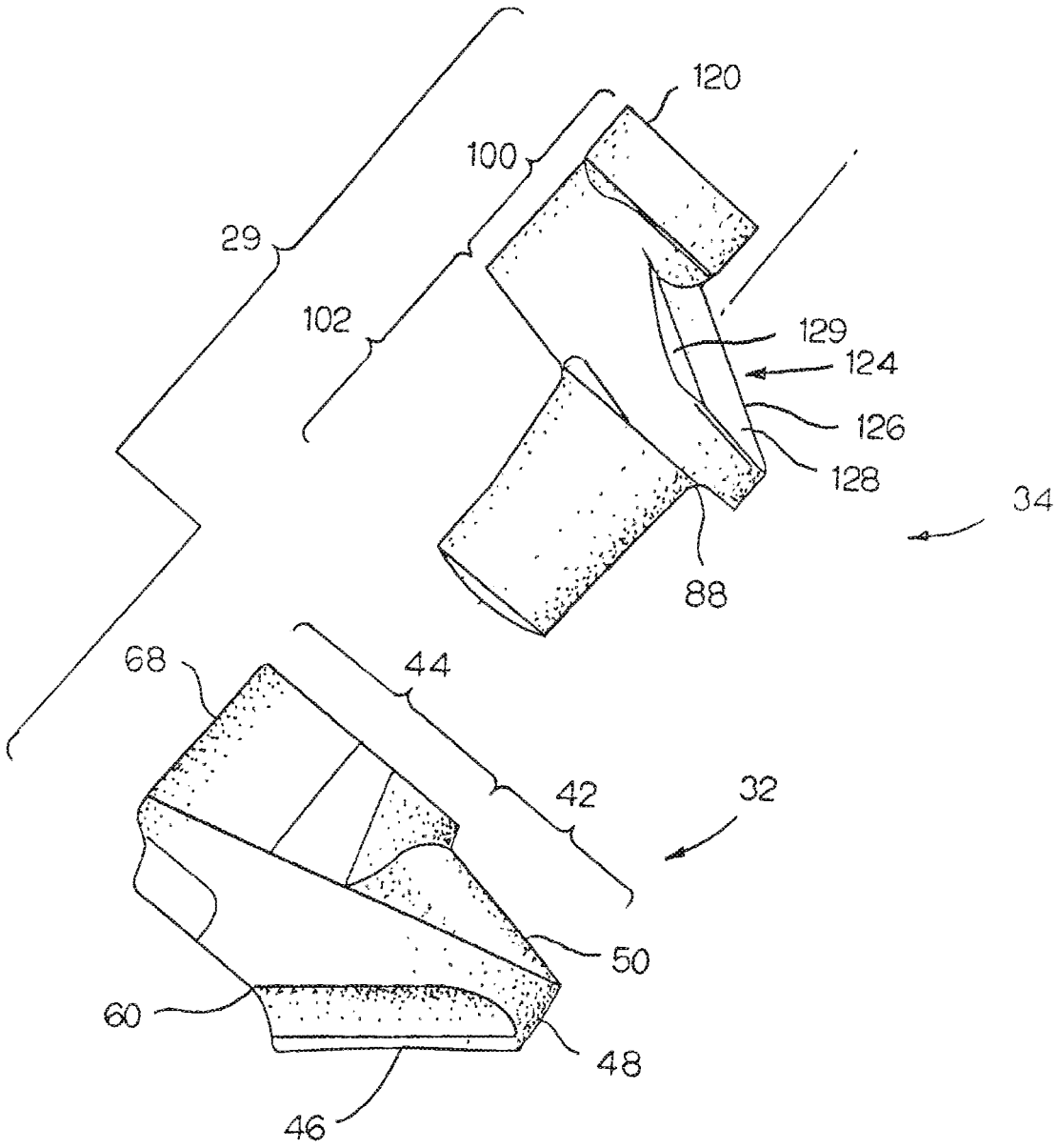
FIG. 2 is a side view of the rotatable cutting tool-tool holder-base assembly wherein the tool holder is exploded away from the base.
Figure 3:
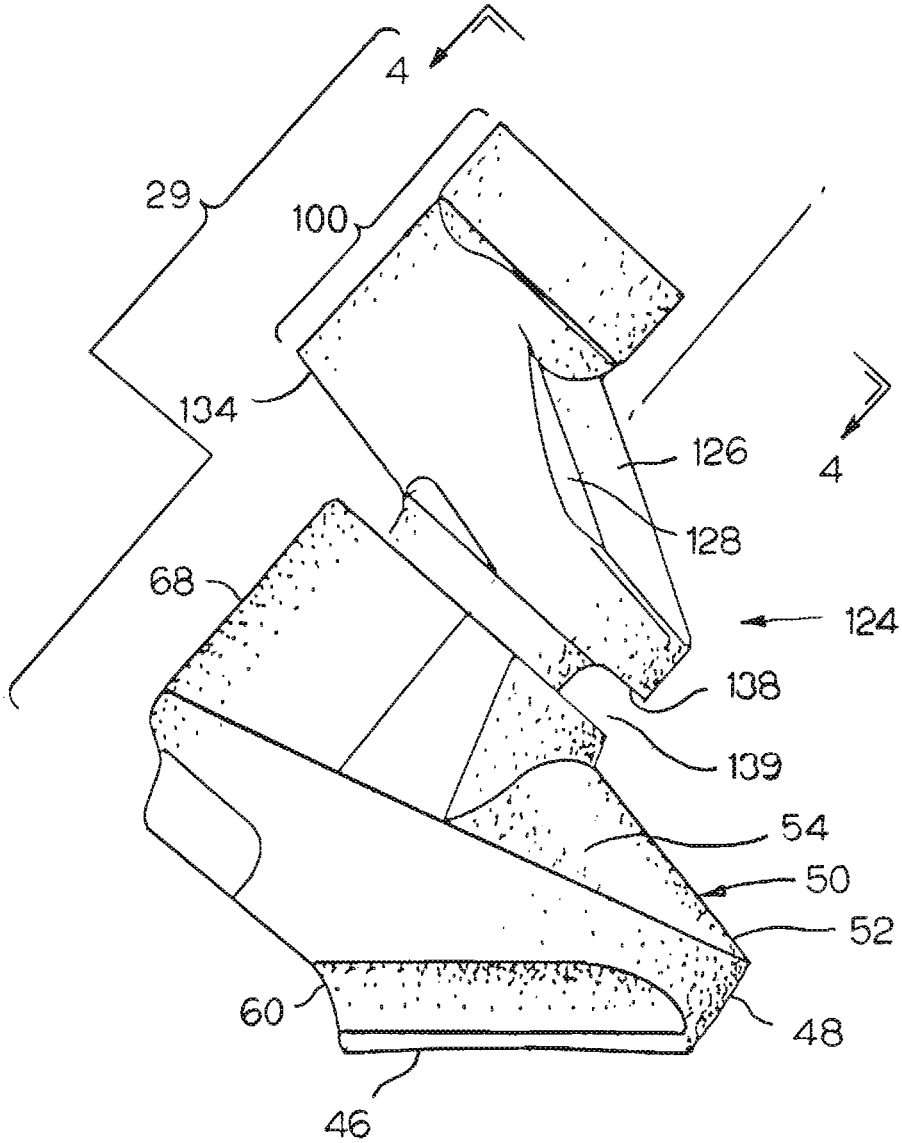
FIG. 3 is a side view of the tool holder-base assembly with the tool holder assembled to the base.

FIG. 2 is a side view of the tool holder-base assembly (see bracket 29) wherein the tool holder 34 is exploded away from the base 32. FIG. 3 is a side view of the tool holder-base assembly with the tool holder 34 assembled to the base 32. A more detailed description of these components is set forth below.

The base 32 comprises a proximate region (see bracket 42) and a distal region (see bracket 44). The proximate region (42) is closer to the surface 40 of the rotatable drum 38 than the distal region 44.

The proximate region 42 has an attachment surface 46, which exhibits a slight degree of concavity. The base 32 can be affixed at the attachment surface 46 to the surface of the drum by welding or the like. The proximate region 42 further comprises an end/leading surface 48, which is adjacent to the surface 40 of the rotatable drum 38. The proximate region 42 further has a leading proximate base surface 50, which has a central portion, i.e., central portion of the leading proximate base surface, 52. The central portion of the leading proximate base surface 52 is intermediate of a pair of spaced apart lateral portions of the leading proximate base surface 54, 56 (see FIG. 7). In reference to the operation of these portions, i.e., central and lateral portions of the leading proximate base surface 52, these surfaces function to help deflect or divert the cutting debris away from the connection between the base 32 and the rotatable drum 38. Such deflection and diversion of debris helps extend the useful life of the base.

The proximate region 42 of the base 32 has a trailing proximate base surface 60. The proximate region 42 of the base 32 contains an orientation bore 62 (see FIG. 4). The orientation bore 62 has a distal end 64, which is away from the surface 40 of the rotatable drum 38, and a proximate end 66, which is closer to the surface 40 of the rotatable drum 38. The orientation bore 62 has a central longitudinal axis B-B.

Figure 4:
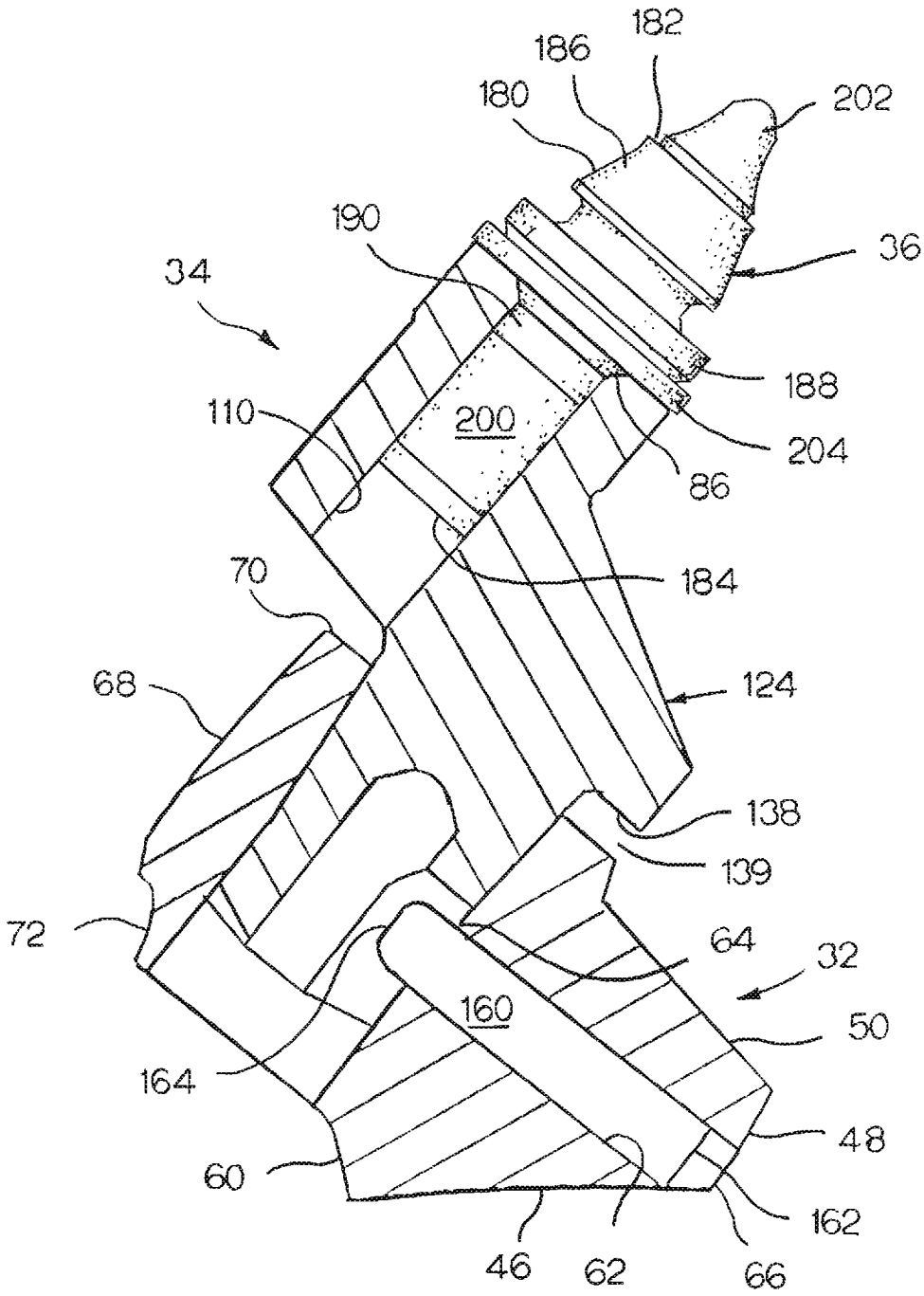
FIG. 4 is a cross-sectional view of one of the rotatable cutting tool-tool holder-base assemblies of FIG. 1 taken along section line 4-4 of FIG. 3 wherein the tool holder and the base are shown in cross-section and the rotatable cutting tool is not shown in cross-section.
Figure 5:
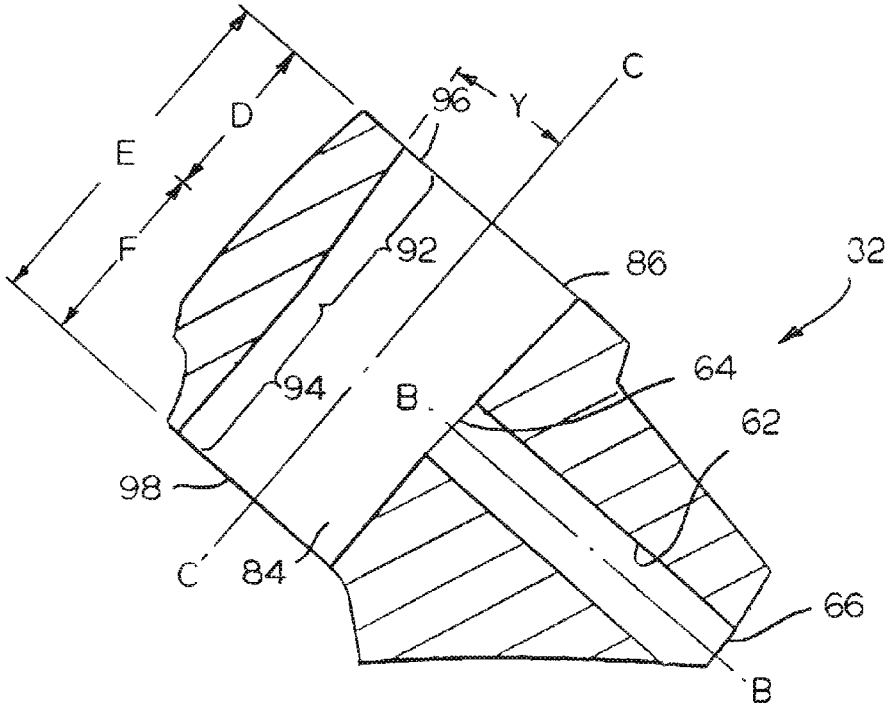
FIG. 5 is a cross-sectional view of the base.

The distal region 44 of the base 32 has a distal end surface 68 that is farthest removed from the surface 40 of the rotatable drum 38. Referring to FIGS. 4 and 5, the distal region 44 also has a leading distal base surface 70 and a trailing distal base surface 72. The distal region 44 of the base 32 contains a tool holder bore 84 (a bore that receives a tool holder), which has a tool holder bore mouth 86 surrounding the same. The tool holder bore 84, which has a central longitudinal axis C-C (see FIG. 5), has a tapered section 92, which has a degree of taper Y equal to about ten degrees. In a preferred embodiment, the length D of the tapered section relative to the overall length E of the tool holder bore 84 is about forty-seven percent. In a preferred embodiment, the tool holder bore 84 has a cylindrical section 94, which has a length F equal to about fifty-three percent of the overall length E of the tool holder bore 84. While the above numerical values are for a preferred embodiment, applicants contemplate that the length D of the tapered section relative to the overall length E may range between about twenty-five percent and about one hundred percent. Applicants also contemplate that the length F of the cylindrical section relative to the overall length E may range between about zero percent and about seventy-five percent.

The tool holder bore 84, which is an open bore, has an axial forward end 96 and an axial rearward end 98. There is access to the rearward end of the tool holder through the axial rearward end 98 of the tool holder bore 84. Through this access, the operator can cause an impact on the rearward end of the tool holder to facilitate to disassembly of the tool holder from the base. As mentioned above, during operation, the tool holder and/or the base may suffer damaged or at least impacted so that disassembly is difficult. The above access facilitates the disassembly of the tool holder from the base. This is an advantage provided by the present invention.

Figure 6:
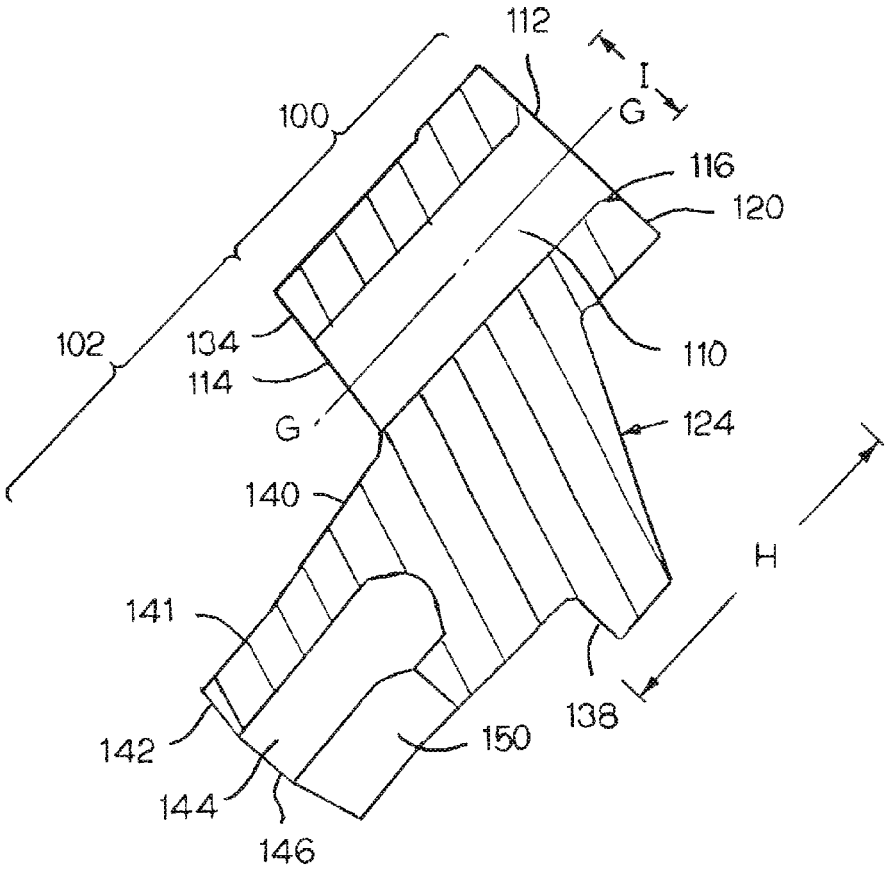
FIG. 6 is a cross-sectional view of the tool holder.
Figure 5A:
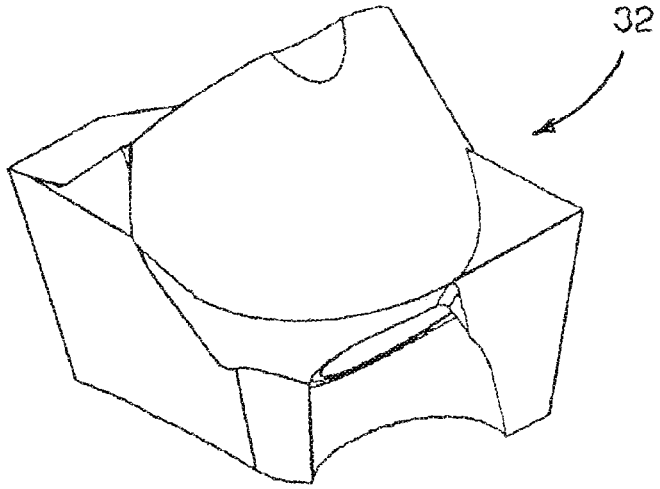
FIG. 5A is an isometric view of the base showing the surface contours of the base.
Figure 5B:
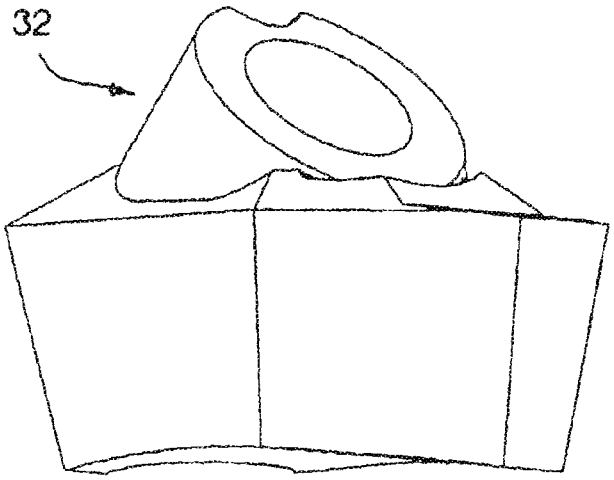
FIG. 5B is another isometric view of the base showing the surface contours of the base.

Referring to FIG. 6, the tool holder 34 has a head region 100 of the tool holder and a shank region 102 of the tool holder. The shank region 102 projects from the head region 100 at location 88 (see FIG. 2). The head region 100 of the tool holder has a rotatable cutting tool bore 110. The rotatable cutting tool bore 110 has a rotatable cutting tool bore central longitudinal axis G-G, as well as a length H and a bore diameter I of the rotatable cutting tool bore 110. The rotatable cutting tool bore 110 has an axial forward end 112 and an axial rearward end 114 of the rotatable cutting tool bore. The rotatable cutting tool bore 110 has a mouth section 116 adjacent to the axial forward end 114 thereof.

Figure 7:
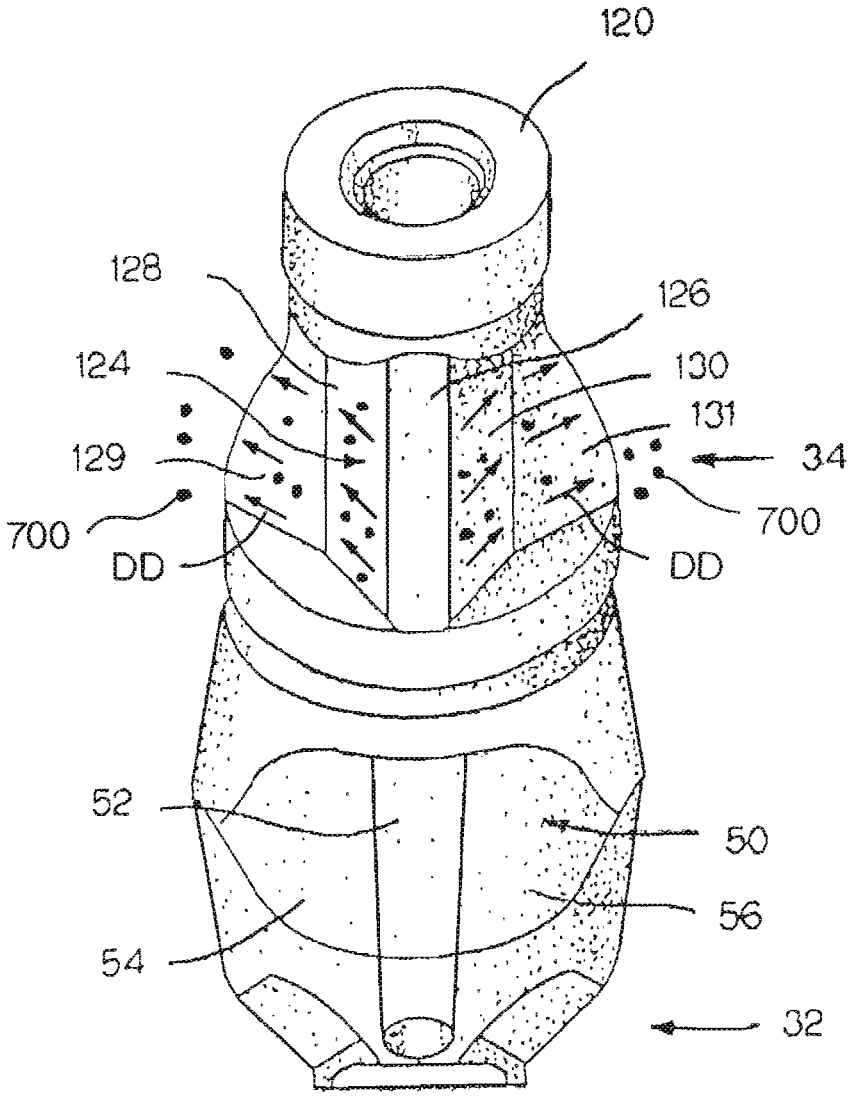
FIG. 7 is a front view of the tool holder-base assembly wherein the tool holder is assembly (attached) to the base.
Figure 7A:
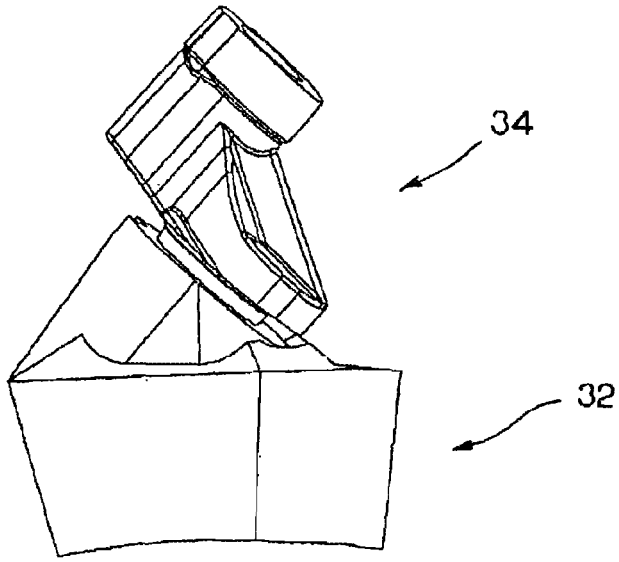
FIG. 7A is a side view of the tool holder-base assembly showing the detailed surface contours of the components.
Figure 7B:
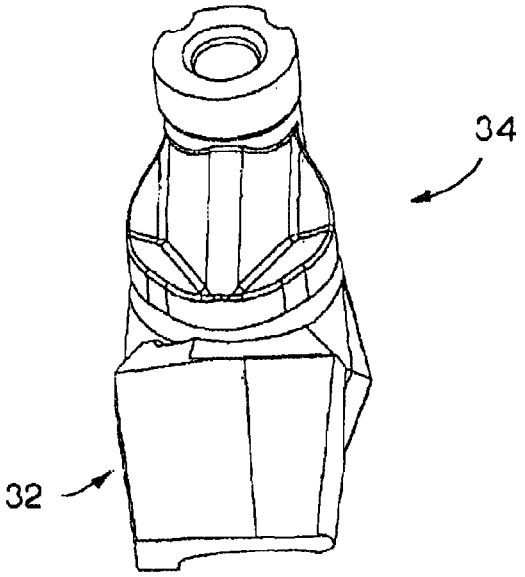
FIG. 7B is a front view of the tool holder-base assembly showing the detailed surface contours of the components.
Figure 7C:
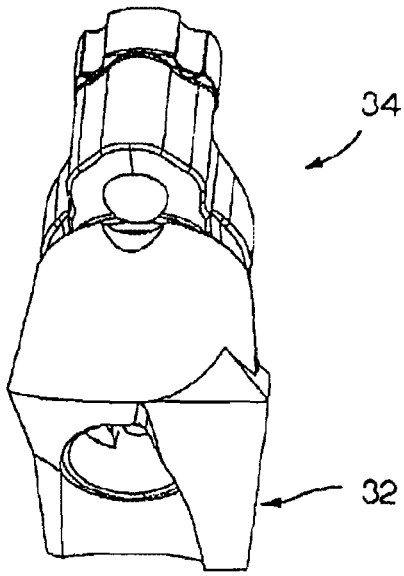
FIG. 7C is a rear view of the tool holder-base assembly showing the detailed surface contours of the components.
Figure 7D:
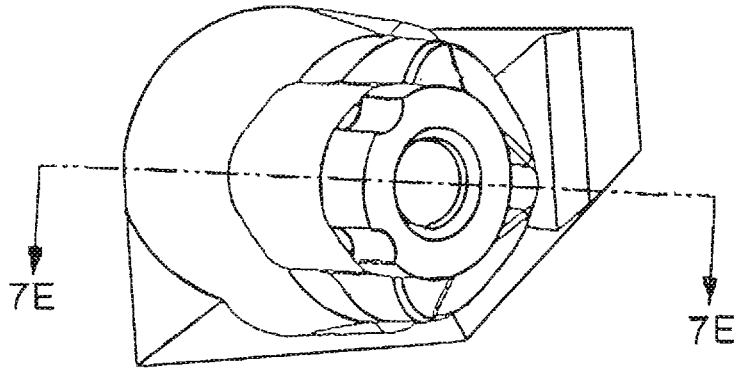
FIG. 7D is a top view of the tool holder-base assembly showing the detailed surface contours of the components.
Figure 7E:
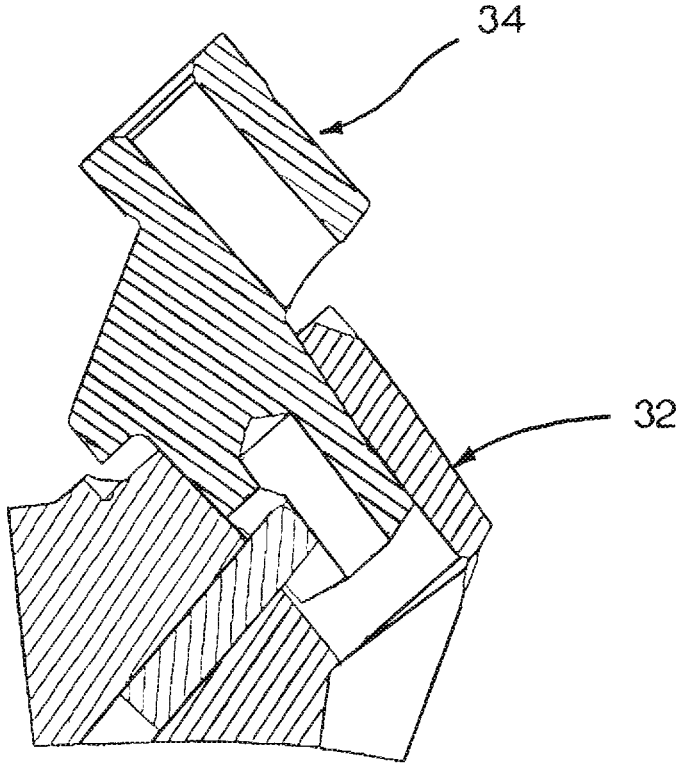
FIG. 7E is a cross-sectional view of the tool holder-base assembly of FIG. 7D taken along section line 7E-7E.
Figure 8:
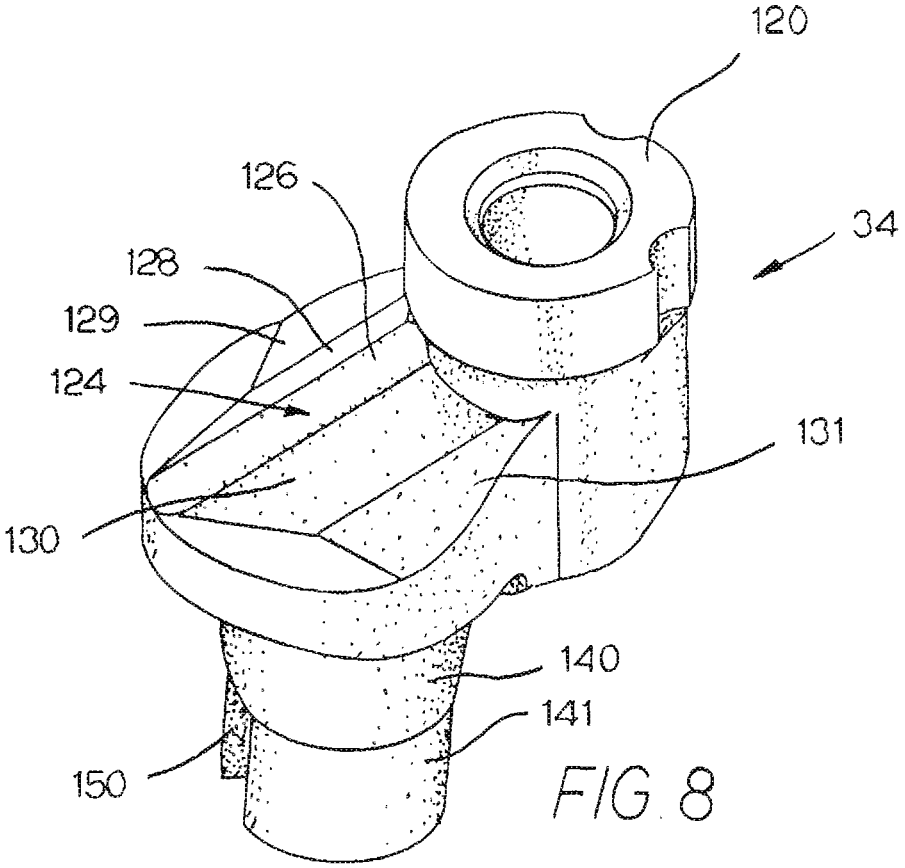
FIG. 8 is an isometric view of the of the tool holder of FIG. 1.
Figure 8A:
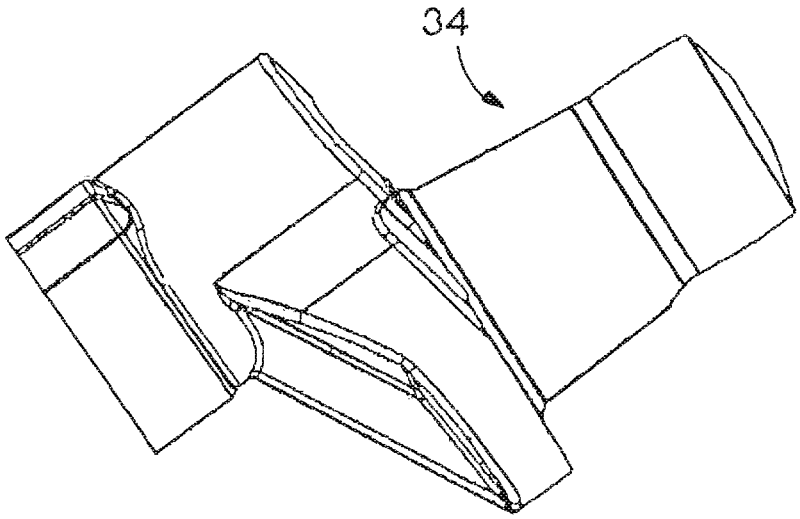
FIG. 8A is a side view of the tool holder showing the detailed surface contours thereof.
Figure 8B:
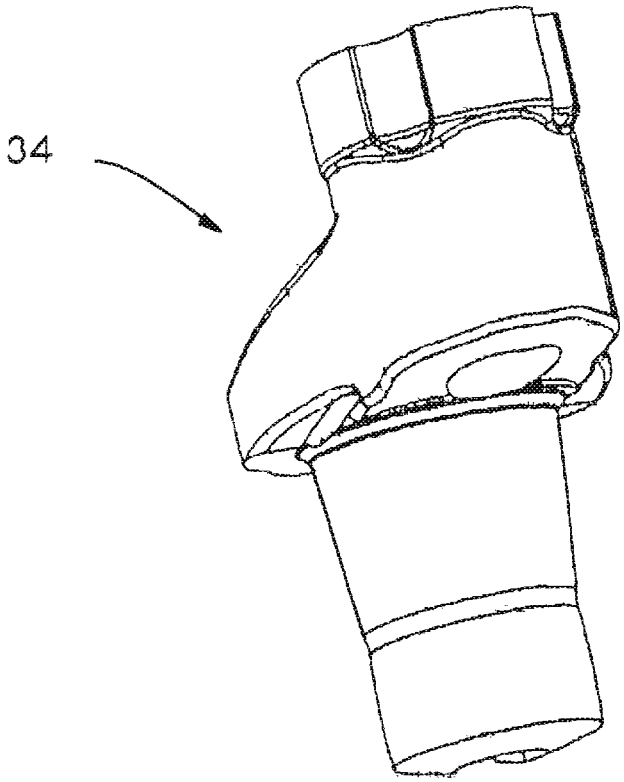
FIG. 8B is an isometric view of the tool holder showing the detailed surface contours thereof.
Figure 8C:
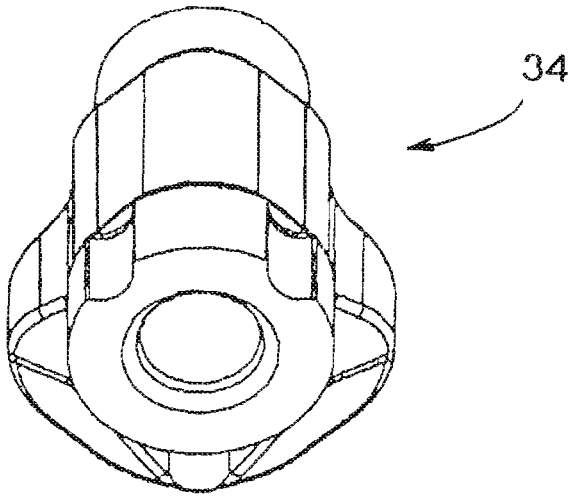
FIG. 8C is a top view of the tool holder showing the detailed surface contours thereof.
Figure 8D:
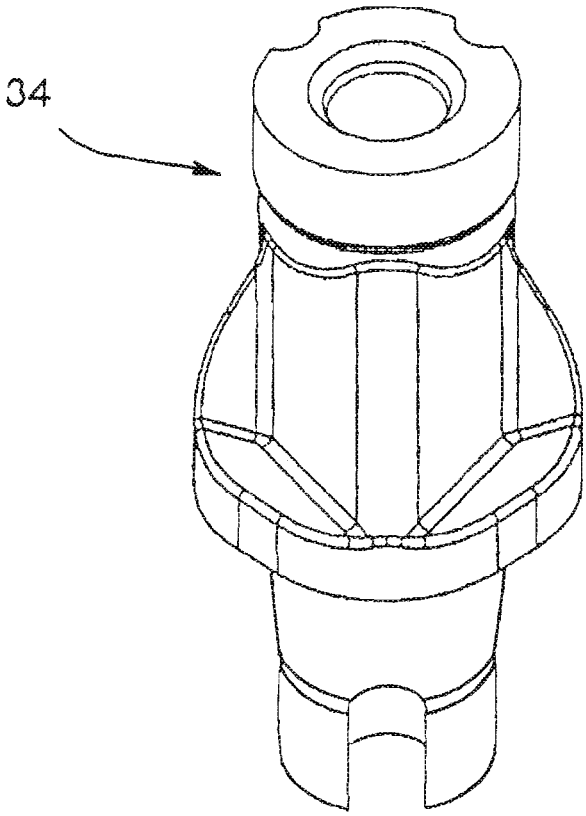
FIG. 8D is a front view of the tool holder showing the detailed surface contours thereof.

The head region 100 of the tool holder 34 has a leading surface 120, a rotatable cutting tool bore leading mouth surface head region, and a protective surface 124. Referring to FIG. 7, the protective surface 124 has mediate section of the head region protective surface 126, a pair of spaced apart lateral sections (surfaces) (128, 130) of the head region protective surface, and another pair of spaced apart peripheral lateral sections (surfaces) 129, 131. The head region 100 of the tool holder 34 has a trailing surface 134 and a rotatable cutting tool bore trailing mouth surface. There is a shoulder surface 138 of the head region of the tool holder facing in an axial rearward direction. There is a gap 139 between the shoulder surface 138 and the base.

The shank region 102 of the tool holder 34 has a tapered external surface 140, as well as an axial rearward end surface 142. A cylindrical surface 141 is adjacent to the end surface 142. The shank region 102 further contains a closed axial rearward bore 144, which has an open end 146. The presence of the closed axial rearward bore 144 provides some radial flexibility to the shank region 102. The relative dimensioning of the shank region 102 and the bore 84 provides for a tight fit (e.g., interference fit) between the base and the tool holder.

The shank region 102 further contains an elongate slot 150.

In reference to FIG. 4, an orientation pin 160 is within the orientation bore 62. The orientation pin 160 has an exterior end 162 and an interior end 164. The interior end 164 projects into the tool holder bore 84 wherein it registers with the elongate slot 150. The orientation between the base and the tool holder is correct when the orientation pin 160 registers in the elongate slot 150. By providing a way to orient correctly the tool holder 34 to the base 32, there is an improvement in the integrity of the connection there between. Correct relative alignment provides for a connection between the base and the tool holder that is more resistant to vibratory loosening during operation.

The rotatable cutting tool 36 comprises a rotatable cutting tool body 180, which has an axial forward end 182 and an axial rearward end 184. The rotatable cutting tool body 180 has a head portion 186, as well as a enlarge diameter shoulder portion 188 and washer 204. The rotatable cutting tool body 180 has a shank portion 190, which carries a resilient retainer 200, which rotatably retains the rotatable cutting tool 36 in the rotatable cutting tool bore 110. The axial forward end 182 of the rotatable cutting tool body 180 carries a hard insert 202, which comprises a hard material such as, for example, cemented (cobalt) tungsten carbide.

The rotatable cutting tool bore 110, which is an open bore, has an axial forward end 112 and an axial rearward end 114. There is access to the rearward end 184 of the rotatable cutting tool 36 through the axial rearward end 114 of the cutting tool bore 110. Through this access, the operator can cause an impact on the rearward end of the cutting tool to facilitate disassembly of the cutting tool from the cutting tool holder. As mentioned above, during operation, the cutting tool and/or the cutting tool holder may suffer damage or at least impact such that disassembly is difficult. The above access facilitates the disassembly of the cutting tool from the cutting tool holder. This is an advantage provided by the present invention.

In operation, the assembly functions to divert debris away from the base. The result is an increase in the useful life of the base. This is an advantageous aspect of the assembly for reasons set forth above. In reference to the debris diversion feature, the arrows DD in FIG. 7 show the travel of the debris 700 upon impingement on the protective surface 124. The debris diverts away from the mediate section 126 as it travels along the lateral sections (or surfaces) and peripheral lateral sections (or surfaces) 129, 131. The diversion of the debris causes it to not impinge the base as much as it would in the absence of the lateral surfaces. Further, the secure connection between the base and tool holder results in a minimum movement between the tool holder and the base so as to be resistant to vibratory loosening which could likewise lead to premature cutting bit wear and failure.

Figure 9:
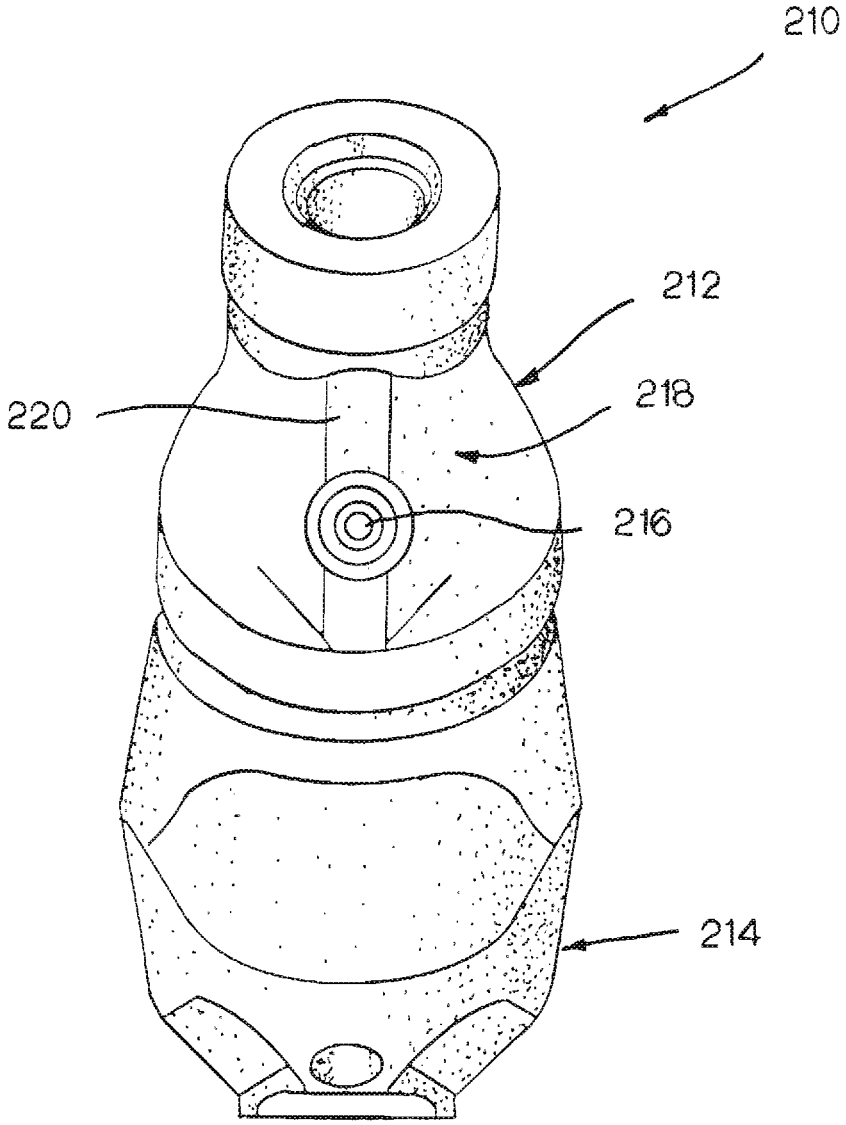
FIG. 9 is a front view of the tool holder-base assembly with the tool holder assembled to the base and wherein the tool holder has a carbide tip in the mediate region of the tool holder.

Referring to FIG. 9, there is a second specific embodiment of the tool holder-base assembly, generally designated as 210. The assembly 210 includes a tool holder 212 and a base 214. The tool holder-base assembly 210 is structurally the same as the tool holder-base assembly of the first embodiment, except for the presence of hard carbide insert 216 in the head region protective surface 218. More specifically, hard carbide insert 216 is in the mediate section 220 of the head region protective surface 218. The presence of the hard carbide tip 216 provides an improvement in the wear resistance of the head region protective surface 218 as compared to a head region protective surface without additional wear protection such as, for example, hard carbide insert 216. The combination of the hard carbide insert 216 and the debris diversion feature result in better protection and performance.

Figure 10:
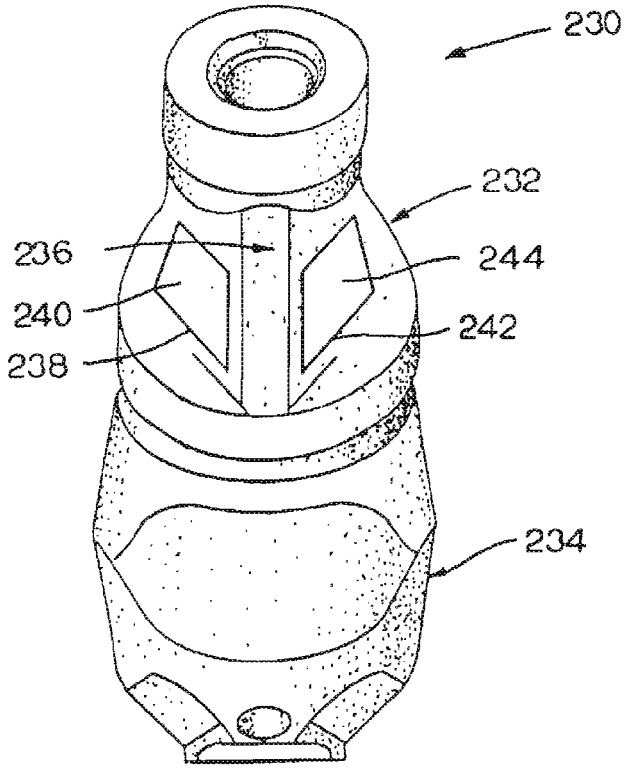
FIG. 10 is a front view of the tool holder-base assembly with the tool holder assembled to the base and wherein the tool holder has a pair of wear plates in the mediate region of the tool holder.

Referring to FIG. 10, there is a third specific embodiment of the tool holder-base assembly, generally designated as 230. The assembly 230 includes a tool holder 232 and a base 234. The tool holder-base assembly 230 is generally structurally the same as the tool holder-base assembly of the first embodiment, except for the presence of hard carbide wear-resistant plates 240, 244 in the head region protective surface 236. More specifically, each one of the lateral sections (238, 242) of the head region protective surface 236 has a hard carbide wear-resistant plate 240 and 244, respectively. The presence of the hard carbide wear-resistant plates 240, 244 provides an improvement in the wear resistance of the head region protective surface 236 as compared to a head region protective surface without additional wear protection such as, for example, hard carbide insert 216 of the specific embodiment of FIG. 9. As an example, the plates 240, 244 may be brazed (affixed) into corresponding sockets in the head region protective surface 236. The combination of the hard plates 240, 244 and the debris diversion feature result in better protection and performance.

Figure 10A:
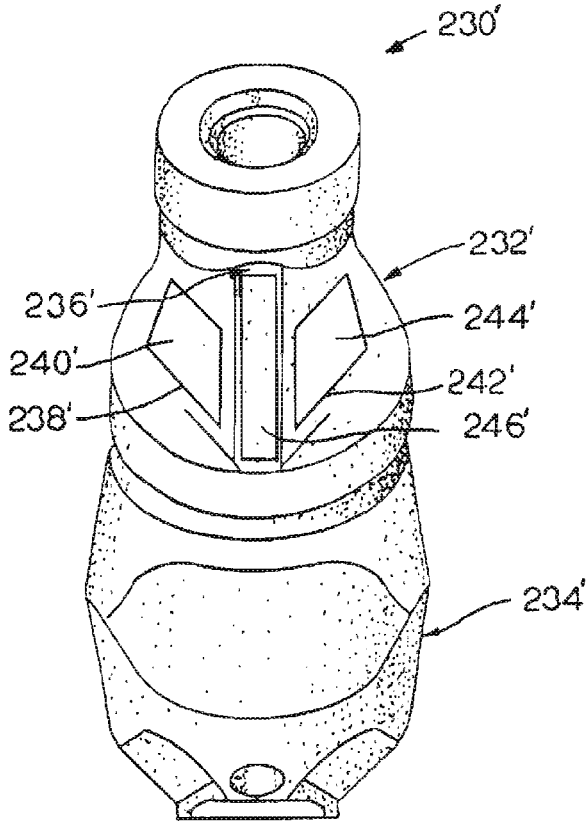
FIG. 10A is a front view of the tool holder-base assembly with the tool holder assembled to the base and wherein the tool holder has a central wear plate and a pair of wear plates in the mediate region of the tool holder.

Referring to FIG. 10A, there is a third specific embodiment of the tool holder-base assembly, generally designated as 230'. The assembly 230' includes a tool holder 232' and a base 234'. The tool holder-base assembly 230' is generally structurally the same as the tool holder-base assembly of the first embodiment, except for the presence of hard carbide wear-resistant plates 240', 244' and the mediate hard (carbide) member 246' in the head region protective surface 236'. More specifically, each one of the lateral sections (238', 242') of the head region protective surface 236' has a hard carbide wear-resistant plate 240' and 244, respectively. Further, there is a hard member or plate 246' on the mediate rib of the protective surface 236'. The presence of the hard carbide wear-resistant plates 240', 244' and the hard member 246' provide an improvement in the wear resistance of the head region protective surface 236' as compared to a head region protective surface without additional wear protection such as, for example, hard carbide insert 216' of the specific embodiment of FIG. 9. As an example, the plates 240', 244' and hard member 246' may be brazed (affixed) into corresponding sockets in the head region protective surface 236'. The combination of the hard plates 240', 244' and hard member 246' and the debris diversion feature result in better protection and performance.

Figure 11:
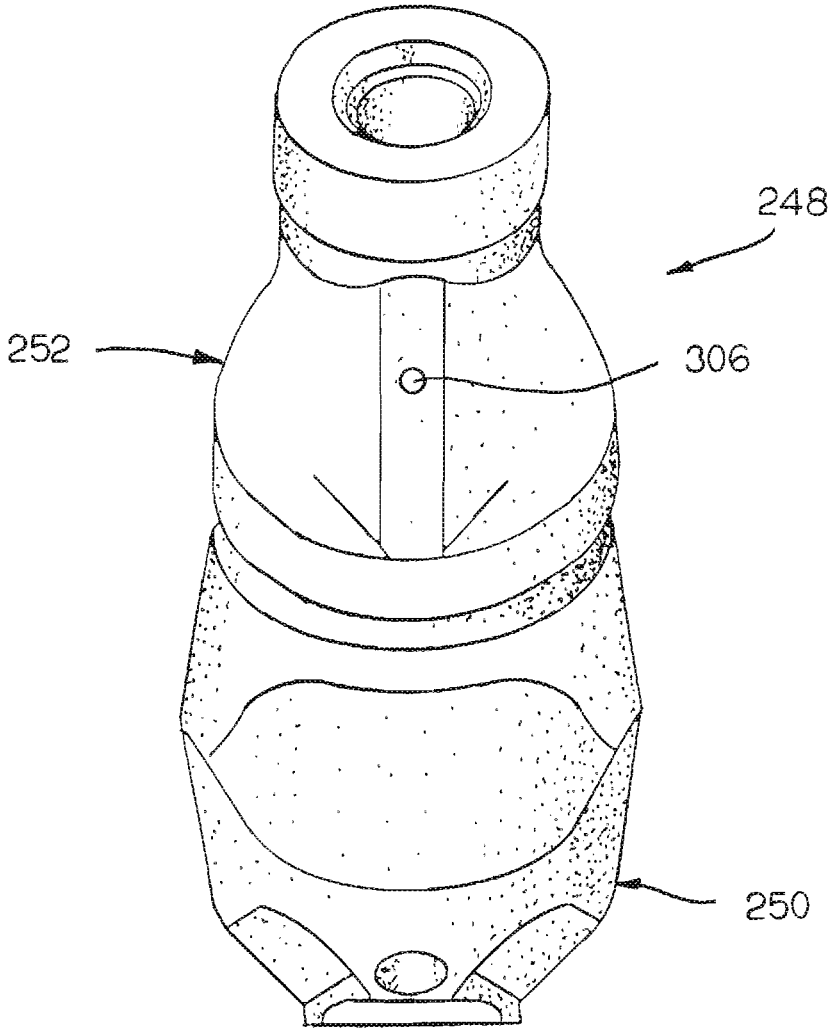
FIG. 11 is a front view of the tool holder-base assembly with the tool holder assembled to the base and wherein the tool holder-base assembly contains a spray assembly that includes a spray nozzle in the mediate region of the tool holder.
Figure 12:
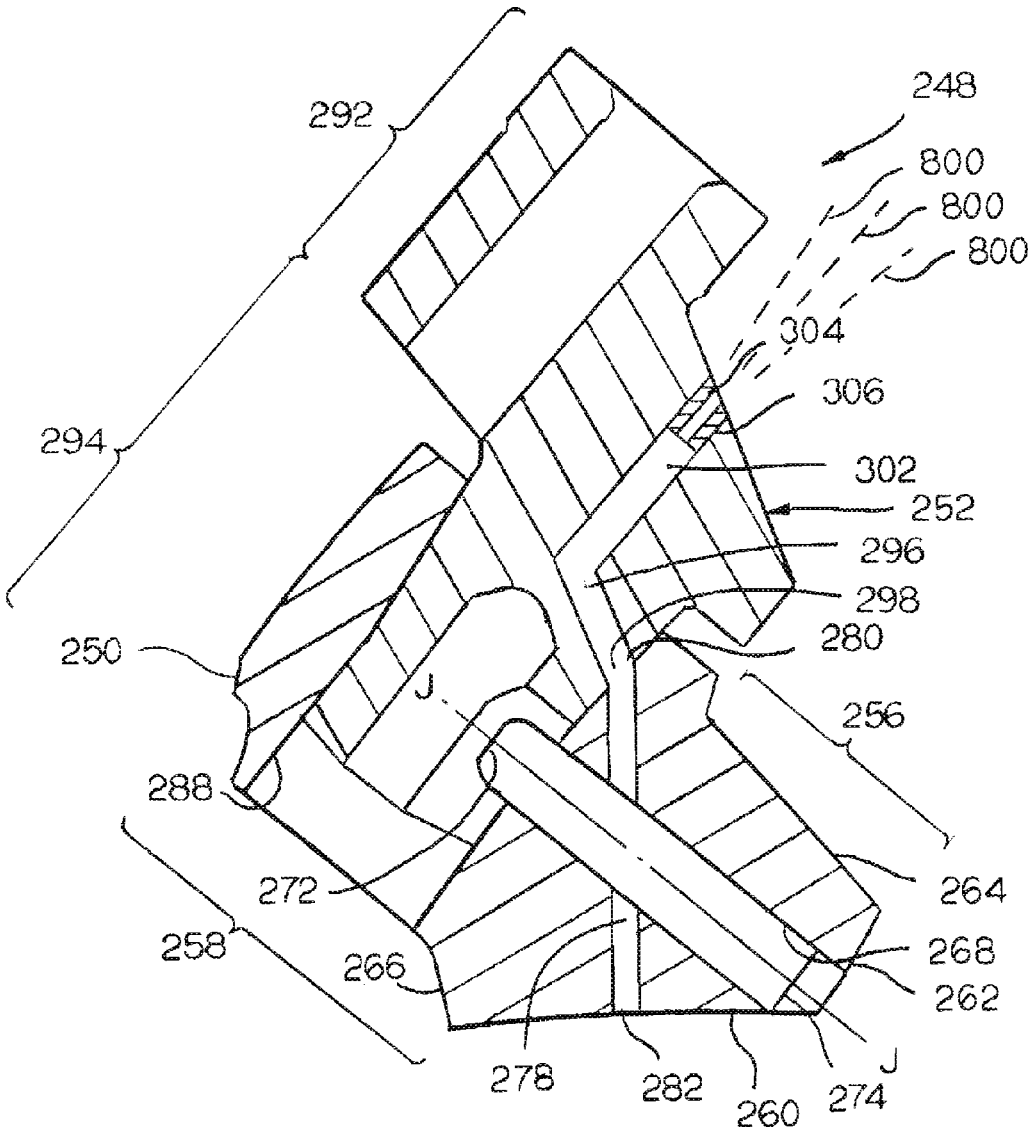
FIG. 12 is a cross-sectional view of the tool holder-base assembly of FIG. 11 showing the passages through the tool holder and the base that supply coolant to the nozzle.

Referring to FIGS. 11-12, there is a fourth specific embodiment of the tool holder-base assembly, generally designated as 248. In this embodiment, the tool holder-base assembly 248 comprises a base 250 and a tool holder 252. The assembly 248 contains a spray assembly that includes a spray nozzle 306 in the mediate region of the tool holder 252, which is the subject of description below. FIG. 12 is a cross-sectional view of the tool holder-base assembly 248 showing the passages through the tool holder and the base that supply coolant to the nozzle.

The presence of the coolant (e.g., a liquid such as water) provides at least two advantages to the overall cutting operation. One advantage is that the coolant facilitates the rotation of the cutting tool in the tool holder due to the cleaning action of the coolant. The coolant acts to help flush the dirt and debris from the vicinity of the cutting tool-tool holder-base assembly. Such a reduction in the amount of the dirt and debris helps the rotation of the cutting tool in the tool holder. Another advantage is that the coolant spray helps with the suppression of dust and fine particulates extant in at least some cutting operations. A cutting operation such a mining operation or a road milling operation can generate dust and other fine particulates, which are in the air. The dust and other fine particulates can be an environmental issue. By spraying the dust and other fine particulates with a fluid spray, the fluid entrains the dust and other fine particulates to remove them from the air in the vicinity of the cutting operation. The with the dust and other fine particulates therein can then be removed to a remote location thereby improving the environmental condition in the vicinity of the cutting operation.

The tool holder-base assembly 248 has a base generally designated as 250 and a tool holder generally designated as 252. The base 250 and the tool holder 252 are structurally along the lines of the tool holder-base assembly of the first embodiment, except for the presence of the components that provide for the spray of coolant. Here, the base 250 has a proximate region 256 and a distal region 258. The proximate region 256 has an attachment surface 260, an end/leading surface 262, a leading proximate base surface 264 and a trailing proximate base surface 266. The proximate region 256 further contains an orientation bore 268, which has an orientation bore central longitudinal axis J-J. The orientation bore 268 has a distal end 272 and a proximate end 274. The proximate region 256 further contains a coolant bore 278, which has a distal end 280 and approximate end 282.

The distal region of the base contains a tool holder bore 288.

The tool holder has a head region 292 and a shank region 294 of the tool holder. The shank region 292 contains a coolant passage 296, which has a coolant passage entrance 298. The head region 292 of the tool holder contains a coolant passage 302, which has a coolant passage exit 304. A nozzle 306 is in the exit 304 of the coolant passage 302.

In operation, the coolant passes and travels through the coolant bore 278 and the coolant passage 296 toward the coolant passage exit 304. A nozzle 306 is near the coolant passage exit 304. The coolant sprays out of the nozzle 306 in a spray 800 (see FIG. 12). The coolant spray helps maintain the operating temperature at a lower level and helps remove cutting debris from the vicinity of the assembly 248.

Figure 13:
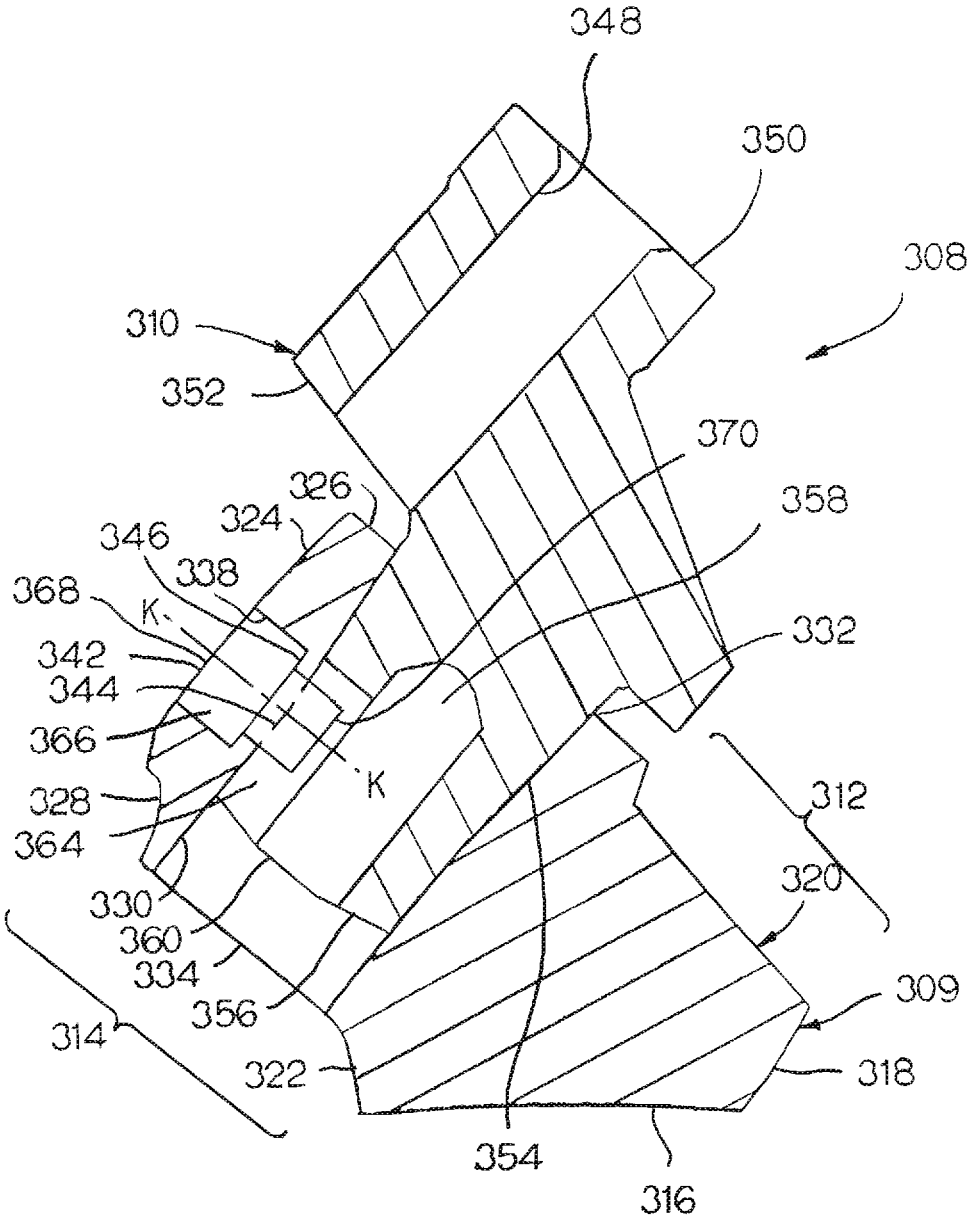
FIG. 13 is a cross-sectional view of another specific embodiment of a tool holder-base assembly showing the tool holder assembled to the base.

FIG. 13 is a cross-sectional view of another specific embodiment of a tool holder-base assembly showing the tool holder 308 assembled to the base 309. The base 309 has a proximate region 312 and a distal region 314. The proximate region 312 has an attachment surface 316 and an end/leading surface 318. The proximate region 312 further has a leading proximate base surface 320 and a trailing proximate base surface 322.

The distal region 314 has a distal end surface 324. The distal region 314 further has a leading distal base surface 326 and a trailing distal base surface 328. The distal region 314 contains a tool holder bore 330, which has an axial forward end 332 and an axial rearward end 334. The distal region 314 contains an orientation bore 338, which has an orientation bore central longitudinal axis K-K. The orientation bore 338 has a distal end 342 and a proximate end 344. The orientation bore 338 has a shoulder 346 mediate of the distal end 342 and the proximate end 344.

The head region of the tool holder contains a rotatable cutting tool bore 348. The head region further includes a leading surface 350 and a trailing surface 352.

The shank region of the tool holder has a tapered external surface 354 and an axial rearward end surface 356. The shank region further contains a closed axial rearward bore 358, which has an open end 360. The shank region of the tool holder contains an elongate slot 364.

An orientation pin 366 has an exterior end 368 and an interior end 370.

In operation, the orientation pin 366 threads into the orientation bore 338 in the base 309. The portion of the pin 366 adjacent to the interior end 370 protrudes into the elongate slot 364. This only occurs when the tool holder 308 correctly aligns with the base 309. When there is incorrect alignment between the tool holder and the base, the rearward end surface 356 of the shank region abuts against the orientation pin 366. It is apparent that the orientation pin 366 cooperates with the elongate slot 364 to facilitate correct orientation of the tool holder and the base.

Referring to FIGS. 15-19, there is illustrated another specific embodiment of the tool holder base assembly designated by brackets has a 399. Tool holder-base assembly 399 comprises a base generally designated as 400. The base 400 has an arcuate surface 402 by which one can attach (for example, by welding) the base 400 to the surface of a driven member (for example, a road milling drum). Base 400 further comprises a leading base surface 404, a trailing base surface 406, one side base surface 408, another side base surface 410, and a top base surface 414.

A collar 416 extends away from the top base surface 414. A tool holder bore 418 travels through the base 400. The collar 416 surrounds the bore 418 at the leading open end 420 thereof. The bore 418 further has a trailing open end 422. The bore 418 presents a tapered, frusto-conical, bore surface 424. The bore 418 has a central longitudinal axis AA-AA. In one range, the half angle of taper (BB-BB) of the bore surface 424 is equal to between about 2½ degrees and about 5½ degrees with the preferred half angle being equal to about 5½ degrees. In another range, the half angle of taper (BB-BB) of the bore surface 424 is equal to between about 2½ degrees and about 7½ degrees with the preferred half angle being equal to about 7½ degrees.

There should be an appreciation that the base 400 further contains a transverse passage 430. Transverse passage 430 passes from one side base surface 408 to the other side base surface 410. Transverse passage 430 intersects the bore 418 at a location so as to create an open slot 432 in the surface 424 of the bore 418.

An elongate pin 436 passes through the transverse passage 430. Elongate pin 436 is of a length so that the opposite end surfaces of the pin 436 are flush with their corresponding ones of the one side base surface 408 and the other side base surface 410. Elongate pin 436 has a cylindrical surface 440. However, there should be an appreciation that the elongate pin may present a geometry other than cylindrical. The geometry may be a shape such that the surface of the elongate pin engages the flat surface 530 of the tool holder 500.

Figure 16:
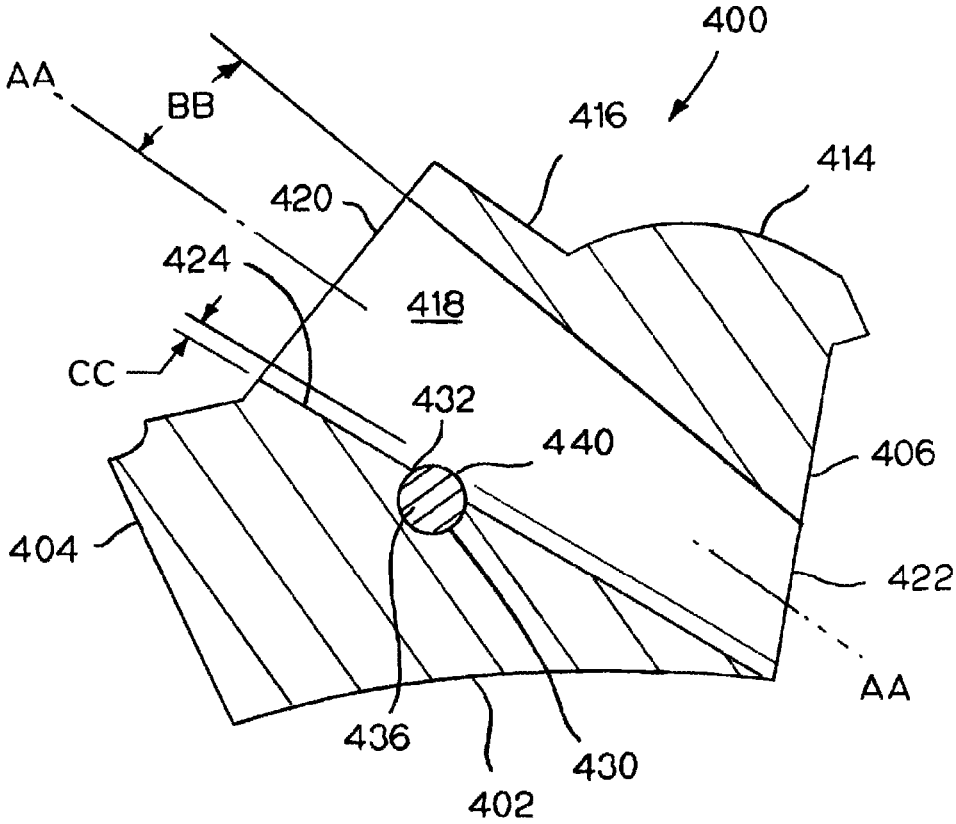
FIG. 16 is a cross-sectional schematic view of the base with an elongate pin in the transverse passage of the base.
Figure 17:
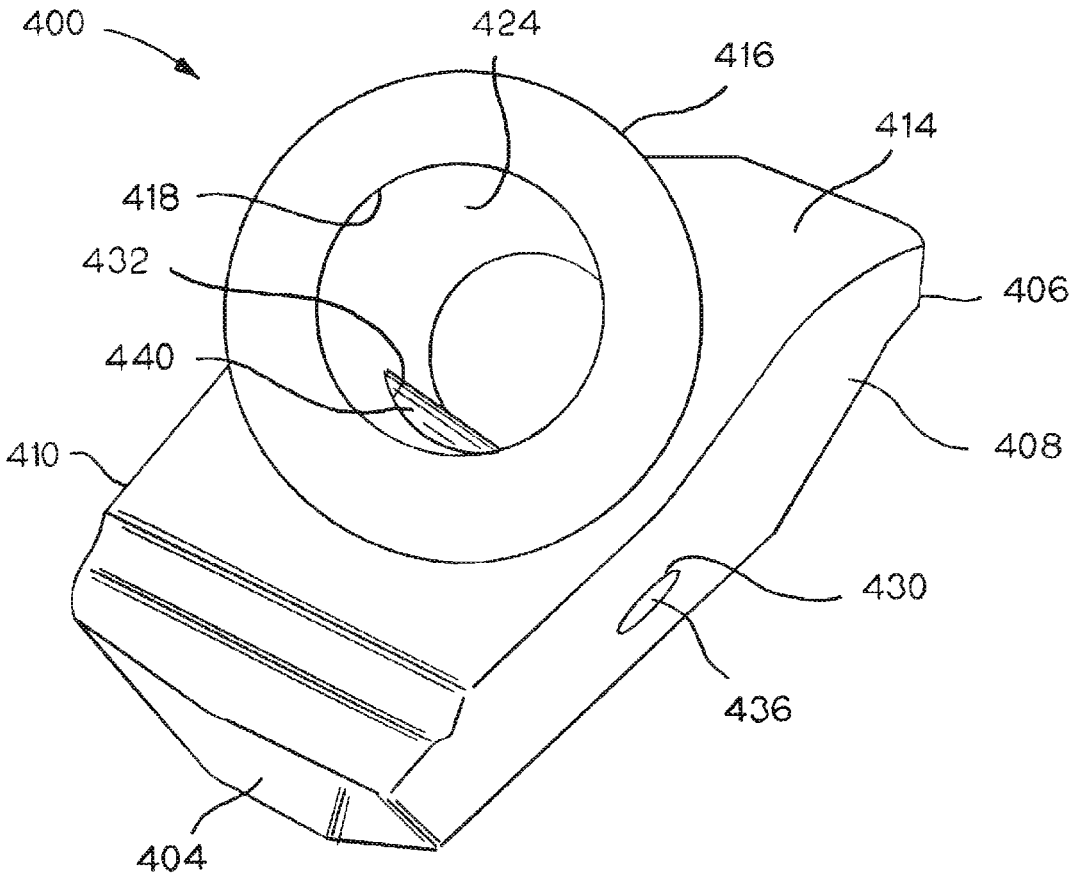
FIG. 17 is an isometric view of a base with the elongate pin attached thereto.

As shown in FIG. 16 and FIG. 17, when in the elongate pin 436 is in the transverse passage 430, a portion of the surface 440 extends into the volume of the tool holder bore 418 a distance "CC". As will be discussed in more detail hereinafter, the cylindrical surface 440 of the elongate pin 436 functions as a bearing surface that facilitates alignment between the base 400 and the tool holder 500.

Figure 18:
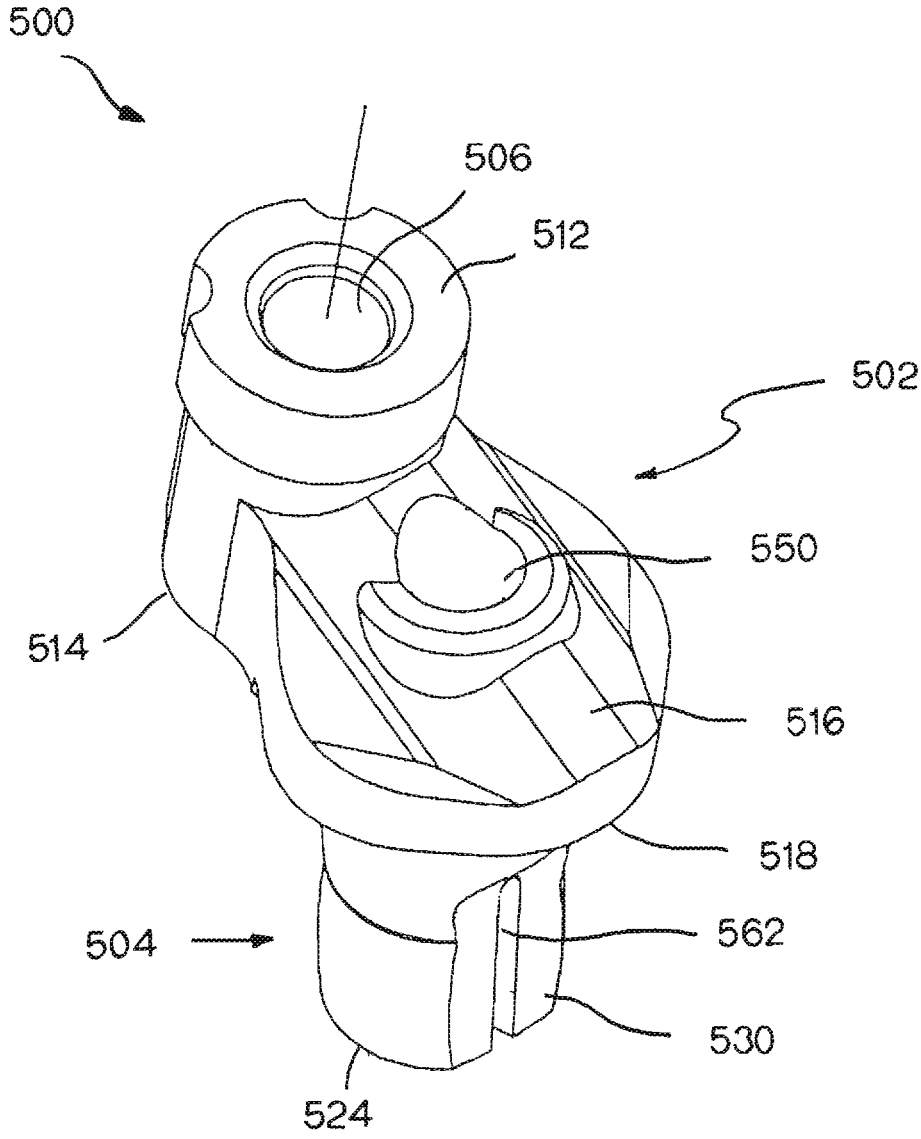
FIG. 18 is a isometric view of the cutting tool holder.
Figure 19:
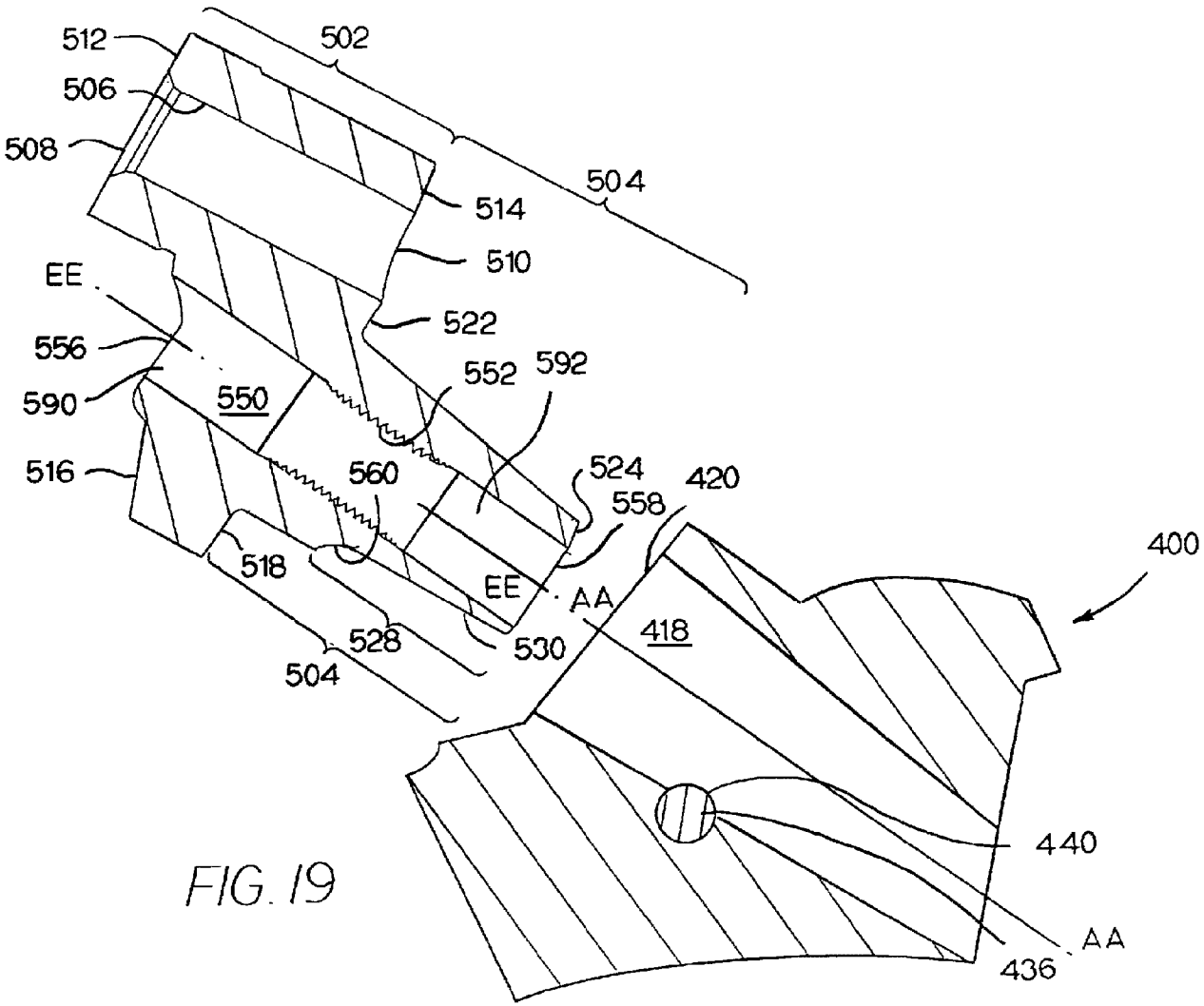
FIG. 19 is a cross-sectional schematic view of the tool holder aligned with respect to the bore of the base.

Referring to the drawings, and especially FIG. 18 and FIG. 19, there is illustrated a tool holder generally designated as 500. The tool holder 500 has a head region shown by bracket 502 in FIG. 19 and an integral shank region shown by bracket 504 in FIG. 19. The head region 502 is axial forward of the shank region 504. The head region 502 contains a rotatable cutting tool bore 506. The rotatable cutting tool bore 506 has an axial forward end 508 and an axial rearward end 510. The head region 502 has a leading surface 512 adjacent the bore 506 and a trailing surface 514 adjacent the bore 506. The head region 502 also has a leading protective surface 516 and a corresponding trailing surface 518.

The head region 502 contains a bore 550 that has a mediate threaded cylindrical surface 552. A threaded bore 550 has a forward end 556 and a rearward end 558. The bore 550 further includes a smooth forward region 590 that extends between the forward end 556 and the mediate threaded surface 552, as well as a smooth rearward region 592 that extends between the rearward end 558 and the mediate threaded surface 552. As will be described in more detail hereinafter, the bore 550 is adapted to receive the threaded section of an installation-removal tool 600. The operator can use the installation-removal tool 600 to better position the tool holder 500 in relation to the base 400.

There should be an appreciation that the bore 550 may be partially threaded or it may be fully threaded. In other words, substantially all of the surface of the bore 550 may be threaded.

The shank region 504 projects from the trailing surface 518 of the head region 502. The shank region 504 has a leading end 522 and an opposite distal trailing end 524. The shank region 504 has a central longitudinal axis EE-EE. The shank region 504 present an alignment region 528 defined by a flat surface 530. The alignment region 528 has a stop 560 at the axial forward end thereof. The shank region 504 contains an elongate slot 562 in the flat surface 530 thereof.

The specific embodiment of the tool holder-base assembly 399 as illustrated in FIGS. 15-19 has a number of advantages as will become apparent.

First, the tool holder-base assembly 399 provides a feature whereby the operator can easily align the tool holder 500 with the base 400 to better facilitate the assembly of these components. As the skilled artisan can appreciate, it is advantageous for the tool holder 500 to align correctly with the base 400 to achieve proper relative alignment upon assembly.

In order to assemble the tool holder 500 to the base 400, the operator positions the shank region 504 to be an axial alignment with the bore 418 of the base 400. More specifically, the central longitudinal axis EE-EE of the shank region 504 is coaxial with the central longitudinal axis AA-AA of the tool holder bore 418. The shank region 504 must have an orientation relative to the base 400 so that the flat surface 530 slides (or rides) over the cylindrical surface 440 of the elongate pin 436. There is the contemplation that the elongate pin may present a geometry other than cylindrical. The flat surface 530 rides over the cylindrical surface 440 as the shank region 504 enters the bore 418 of the base 400 to accomplish proper alignment. The dimensioning of the flat surface 530 relative to the position of the elongate pin 436 is such that upon assembly of the tool holder 500 and the bore 418 of the base 400, a cylindrical surface 440 of the elongate pin 436 rests (or can rest) against the stop 562. One can see that the elongate pin has an exposed portion that passes through the tool holder bore. The cutting tool holder is able to enter completely the tool holder bore of the base when the alignment surface is in alignment with the exposed portion of the elongate pin.

The geometry of the shank region 504 and the tool holder bore 418 is such that there is a matching taper between the two components. Further, the exterior surface of the shank region 504 has a collapsible toroidal geometry such that there is an interference fit between the shank region 504 and the tool holder bore 418. The relative geometries between the shank region 504 and the tool holder bore 418 is along the lines of the KPF303R sleeve and the KPF301 base, both made by Kennametal Inc. of Latrobe, Pa. 15650.

There should be an appreciation that if the tool holder 500 is not aligned with the base 400 as described above, the distal trailing end 524 of the shank 504 will abut against the elongate pin 436. Only when there is sufficient clearance due to the depth of the alignment region 528 will the tool holder 500 clear the elongate pin 436.

Figure 20:
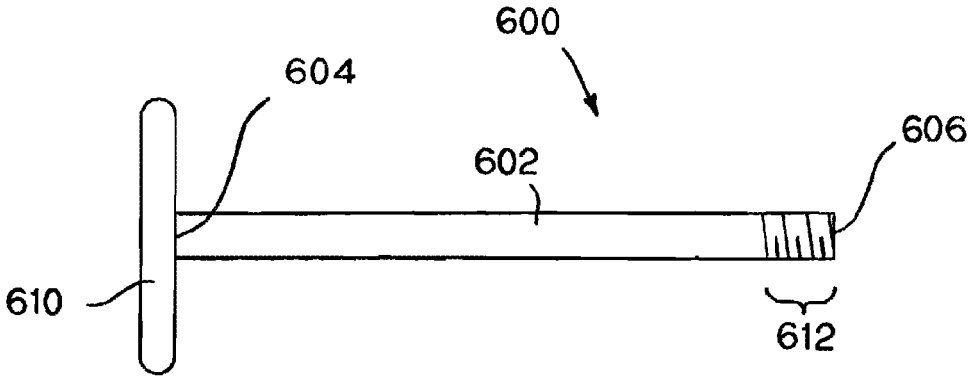
FIG. 20 is a schematic view of the installation-removal tool.

The tool holder-base assembly 399 has another advantageous feature, which is the ease with which the operator can move or position the tool holder 500 relative to the base 400. The installation-removal tool 600 allows the operator to accomplish this task. Referring to FIG. 20, the installation-removal tool 600 has an elongate shank 602, which has opposite ends 604 and 606. A handle 610 is at the one end 604 and a threaded region 612 is at the other end 606.

To engage the tool holder 500, the operator takes the installation removal tool 600 and inserts the threaded region 612 into the bore 550. The operator then threads the threaded region 612 into mediate threaded surface 552. Once the threaded connection is secure, the operator can then transport or position the tool holder 500 to align and then attach the tool holder 500 to the base 400. After the tool holder 500 attaches to the base 400, the operator can then unthreaded the installation-removal tool 600 from the threaded bore 550.

As one can appreciate, when the need arises to detach the tool holder 500 from the base 400, the operator can insert the threaded region 612 of the installation-removal tool 600 into the bore 550 of the tool holder 500. The operator then threads the threaded region 612 into mediate threaded surface 552. The operator can then remove the tool holder 500 from the base. The operator can then unthread the installation-removal tool 600 from the tool holder 500.

As one can appreciate, the present invention uses a cutting bit holder, sometimes referred to as a cutting bit sleeve or a cutting tool holder, wherein the cutting bit rotatably or otherwise mounts in a releasable fashion within the cutting bit holder. The cutting bit holder mounts within the support block via a mechanical connection. The presence of the cutting bit holder helps protect the support block from abuse and wear, thus minimizing or eliminating the periods of down time otherwise required for drum repair. As one can also appreciate, the present invention provides a way to mount the cutting bit holder in the support block to minimize movement of the cutting bit holder in order to maximize the useful life of the cutting bit. In this regard, the present provides a mounting between the cutting bit holder and the support block that is resistant to vibratory loosening which could likewise lead to premature cutting bit wear and failure. As one can also appreciate, the present invention provides a cutting bit holder-support block assembly that facilitates a relatively easy disassembly of the cutting bit holder from the support block.

The patents and other documents identified herein are hereby incorporated by reference herein. Other embodiments of the invention will be apparent to those skilled in the art from a consideration of the specification or a practice of the invention disclosed herein. It is intended that the specification and samples are illustrative only and are not intended to be limiting on the scope of the invention. The true scope and spirit of the invention is indicated by the following claims.

What is claimed is:

1. A tool holder-base assembly wherein the base is adapted to attach to a surface of a rotatable driving member, the tool holder-base assembly comprising;

a base;

the base contains a tool holder bore having a tool holder bore central longitudinal axis, the base further contains an orientation bore having an orientation bore central longitudinal axis, the orientation bore opens into the tool holder bore, the orientation bore central longitudinal axis being disposed generally perpendicular to the tool holder bore central longitudinal axis;

a tool holder having a leading head region and a trailing shank region, and a mediate region intermediate of and contiguous with the leading head region and the trailing shank region;

the leading head region of the tool holder contains a rotatably cutting tool bore;

the trailing shank region containing an orientation slot;

the mediate region presenting a forward protective surface defining debris diversion surfaces and wherein the forward protective surface comprising a pair of opposite lateral sections, and each one of the lateral sections containing a hard plate; and an orientation pin received within the orientation bore so as to project into the orientation slot wherein the orientation pin cooperates with the orientation slot in the tool holder so the tool holder presents a correct orientation relative to the base.

2. A tool holder-base assembly according to claim 1 wherein the base having a proximate region and a distal region, the proximate region having a surface that is attachable to the surface of the rotatable driving member, and the orientation bore opening at the proximate region of the base.

3. A tool holder-base assembly according to claim 1 wherein the base having a proximate region and a distal region, the proximate region having a surface that is attachable to the surface of the rotatable driving member, and the orientation bore opening at the distal region of the base.

4. A tool holder-base assembly according to claim 1 wherein the forward protective surface comprising a mediate rib surface containing a hard member.

5. A tool holder-base assembly according to claim 1 wherein the tool holder bore having an open axial rearward end.

* * * * *